US011525623B2

(12) United States Patent
Dhage et al.

(10) Patent No.: US 11,525,623 B2
(45) Date of Patent: Dec. 13, 2022

(54) WATER DISPENSING SYSTEM

(71) Applicant: WHIRLPOOL CORPORATION, Benton Harbor, MI (US)

(72) Inventors: Atishkumar S. Dhage, Pune (IN); Vikas C. Mruthyunjaya, St. Joseph, MI (US); Caroline Ruella Paiva Torres, Joinville (BR); Henrique Keiji Arai Yamaki, Joinville (BR); Ravi Joshi, St. Jospeh, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/386,825

(22) Filed: Jul. 28, 2021

(65) Prior Publication Data

US 2021/0356199 A1 Nov. 18, 2021

Related U.S. Application Data

(63) Continuation of application No. 16/431,205, filed on Jun. 4, 2019, now Pat. No. 11,098,948.

(51) Int. Cl.

| | |
|---|---|
| ***F25D 23/12*** | (2006.01) |
| ***B67D 3/00*** | (2006.01) |
| ***F25D 25/00*** | (2006.01) |

(52) U.S. Cl.

CPC ..... *F25D 23/126* (2013.01); *B67D 3/0041* (2013.01); *B67D 3/0061* (2013.01); *F25D 25/005* (2013.01); *F25D 2323/122* (2013.01)

(58) Field of Classification Search

CPC ..... F25D 23/126; F25D 25/005; F25D 2323/122; B67D 3/0041; B67D 3/0061

USPC ..... 141/351

See application file for complete search history.

(56) References Cited

U.S. PATENT DOCUMENTS

| | | | |
|---|---|---|---|
| 5,316,195 | A | 5/1994 | Moksnes et al. |
| 5,490,547 | A | 2/1996 | Abadi et al. |
| 5,881,533 | A | 3/1999 | Focke et al. |
| 8,677,778 | B2 | 3/2014 | Jeon et al. |
| 9,557,097 | B2 | 1/2017 | McMahan et al. |
| 9,719,720 | B2 | 8/2017 | Seo et al. |
| 9,945,603 | B2 | 4/2018 | Hwang et al. |
| 10,077,183 | B2 | 9/2018 | McMahan et al. |
| 10,107,546 | B2 | 10/2018 | Lee et al. |
| 10,119,752 | B2 | 11/2018 | Jeong et al. |
| 10,837,698 | B2 | 11/2020 | Choy et al. |
| 2007/0278141 | A1 | 12/2007 | Patera et al. |

(Continued)

FOREIGN PATENT DOCUMENTS

| | | |
|---|---|---|
| BR | PI9500787 | 10/1995 |
| BR | PI0403144 | 3/2006 |

(Continued)

*Primary Examiner* — Timothy L Maust
*Assistant Examiner* — Christopher M Afful
(74) *Attorney, Agent, or Firm* — Price Heneveld LLP

(57) ABSTRACT

A refrigerator water dispenser includes a shelf having a lower surface. A water dispenser tube is disposed adjacent to the shelf for dispensing water into a container. An actuator support is operably coupled to the lower surface of the shelf. A load cell is disposed on the actuator support, wherein the load cell sends a signal in response to movement by the actuator support. A controller is operably coupled to the load cell, wherein the controller activates a water dispensing sequence to dispense water via the water dispenser tube in response to the signal from the load cell.

20 Claims, 19 Drawing Sheets

(56) References Cited

U.S. PATENT DOCUMENTS

| | | | |
|---|---|---|---|
| 2011/0036126 | A1 | 2/2011 | Gerster et al. |
| 2012/0042671 | A1 | 2/2012 | Jeon et al. |
| 2014/0320647 | A1 | 10/2014 | Seo et al. |
| 2015/0144651 | A1 | 5/2015 | Berger et al. |
| 2017/0241700 | A1 | 8/2017 | Mitchell |
| 2018/0209718 | A1 | 7/2018 | Staud et al. |

FOREIGN PATENT DOCUMENTS

| | | | |
|---|---|---|---|
| BR | MU8702312 | | 6/2009 |
| BR | MU8800759 | | 10/2009 |
| BR | PI0621329 | | 12/2011 |
| BR | 102012019991 | | 12/2013 |
| BR | 102015031525 | | 6/2017 |
| CN | 201170617 | Y | 12/2008 |
| CN | 202392848 | U | 8/2012 |
| CN | 202521665 | U | 11/2012 |
| CN | 203053527 | U | 7/2013 |
| CN | 103925972 | A | 7/2014 |
| CN | 107177964 | A | 9/2017 |
| DE | 2844755 | A1 | 4/1980 |
| DE | 19610092 | A1 | 9/1997 |
| DE | 102015207409 | A1 | 10/2016 |
| EP | 1953291 | A1 | 8/2008 |
| EP | 2420778 | A2 | 2/2012 |
| GB | 2507929 | A | 5/2014 |
| JP | 5864429 | | 4/1983 |
| JP | 6237739 | | 8/1987 |
| WO | 0127376 | A1 | 4/2001 |
| WO | 03002953 | A1 | 1/2003 |
| WO | 2015197065 | A1 | 12/2015 |
| WO | 2016024730 | A1 | 2/2016 |
| WO | 2016151814 | A1 | 9/2016 |
| WO | 2016179424 | A1 | 11/2016 |
| WO | 2017020912 | A1 | 2/2017 |

WATER DISPENSING SYSTEM

CROSS-REFERENCE TO RELATED APPLICATIONS

This application is a continuation of and claims priority to U.S. patent application Ser. No. 16/431,205, filed on Jun. 4, 2019, entitled "WATER DISPENSING SYSTEM," now U.S. Pat. No. 11,098,948, the disclosure to which is hereby incorporated herein by reference in its entirety.

FIELD OF THE DISCLOSURE

The present disclosure generally relates to a water dispensing system, and more specifically, to a refrigerator water dispensing system.

BACKGROUND OF THE DISCLOSURE

Refrigerated appliances typically include a water dispenser. The water dispenser is often positioned on an outer surface of a door of the refrigerated appliance. The water dispenser is typically activated by a user. Other water dispensers may include sensors for activating the water dispenser to dispense water.

SUMMARY OF THE DISCLOSURE

According to one aspect of the present disclosure, a refrigerator water dispenser includes a shelf having a lower surface. A water dispenser tube is disposed adjacent to the shelf for dispensing water into a container. An actuator support is operably coupled to the lower surface of the shelf. A load cell is disposed on the actuator support, wherein the load cell sends a signal in response to movement by the actuator support. A controller is operably coupled to the load cell, wherein the controller activates a water dispensing sequence to dispense water via the water dispenser tube in response to the signal from the load cell.

According to another aspect of the present disclosure, a water dispensing system includes a shelf having a lower surface and a water dispenser tube disposed adjacent to the shelf. A tension load cell assembly is operably coupled to the shelf, wherein the tension load cell assembly sends a signal in response to movement relative to the shelf. A controller is operably coupled to the tension load cell assembly for activating a water dispensing sequence in response to the signal from the tension load cell assembly.

According to yet another aspect of the present disclosure, a water dispensing system includes a shelf and a water dispenser tube disposed adjacent to the shelf. At least one actuating support member is operably coupled to the shelf. A tension load cell extends between the shelf and the actuating support member. A controller is operably coupled to the tension load cell for activating a water dispensing sequence in response to a signal from the tension load cell.

These and other features, advantages, and objects of the present disclosure will be further understood and appreciated by those skilled in the art by reference to the following specification, claims, and appended drawings.

Figure 1:
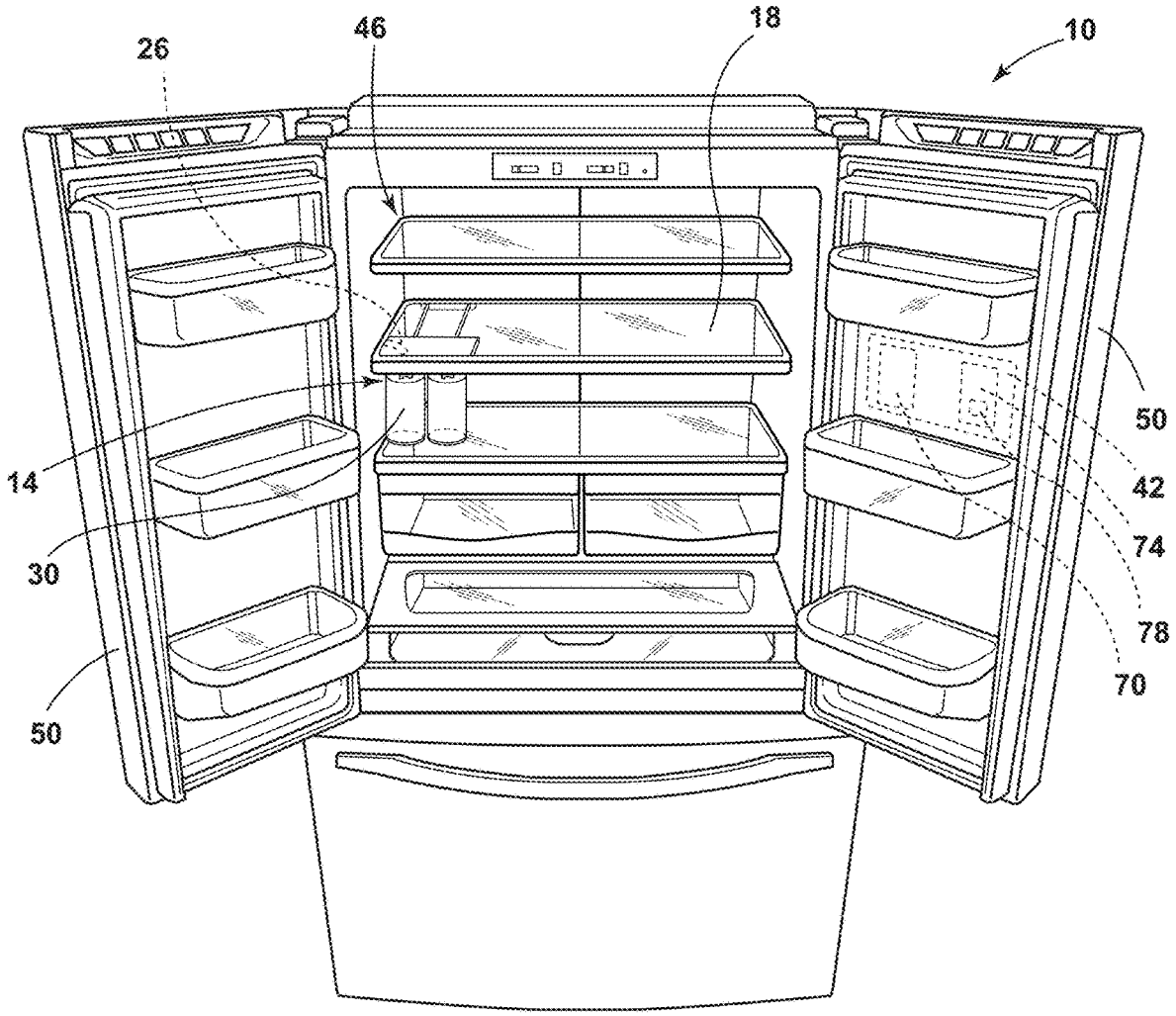
FIG. 1 is a front perspective view of a water dispensing system disposed within a cabinet of a refrigerator, according to one example.

The components in the figures are not necessarily to scale, emphasis instead being placed upon illustrating the principles described herein.

DETAILED DESCRIPTION

The present illustrated embodiments reside primarily in combinations of method steps and apparatus components related to a water dispensing system. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-19, reference numeral 10 generally designates a refrigerator having a water dispensing system 14. The water dispensing system 14 includes a shelf 18 having a lower surface 22. A water dispenser tube 26 is disposed adjacent to the shelf 18 for dispensing water into a container 30. An actuator support 34 is operably coupled to the lower surface 22 of the shelf 18. A load cell 38 is disposed on the actuator support 34, wherein the load cell 38 sends a signal in response to movement by the actuator support 34. A controller 42 is operably coupled to the load cell 38, wherein the controller 42 activates a water dispensing sequence to dispense water via the water dispenser tube 26 in response to the signal from the load cell 38.

Referring to FIG. 1, the shelf 18 of the water dispensing system 14 is illustrated within a cabinet 46 of the refrigerator 10. However, it is contemplated that the water dispensing system 14 may be included in other appliances, or in any storage space having the shelf 18. Accordingly, the water dispensing system 14 may fill the container 30 with minimal user interaction. The water dispensing system 14 may be disposed inside the cabinet 46 of the refrigerator 10 and concealed from the view of a user when refrigerator doors 50 are in a closed position. The container 30 may be supported by the water dispensing system 14. The container 30 may be, for example, a bottle, a pitcher, or another type of container 30. In other words, a user may couple the container 30 to the water dispensing system 14 and may not hold the container 30 while water is inserted into the container 30 via the water dispensing sequence. As discussed herein, the water dispensing sequence operates to add water to the container 30 associated with the water dispensing system 14. The water may be inserted via the water dispenser tube 26, which may be coupled to a fill tube and/or a water supply line to obtain water from an internal and/or external water supply proximate the refrigerator 10.

Referring to FIGS. 2-12, the water dispensing system 14 includes the actuator support 34 with the load cell 38 disposed adjacent to the actuator support 34. The actuator support 34 may define a circular or oblong cross-sectional shape, or other polygonal or irregular shape. In various examples, the cross-sectional shape of the actuator support 34 may correspond to a cross-sectional shape of the container 30. The container 30 may be inserted into the actuator support 34 to receive water from the water dispenser tube 26. The actuator support 34 may define a slot 54 for receiving a locating flange 58 of the container 30. The slot 54 may have an insertion portion 62 and a locking portion 66. The locating flange 58 can be aligned and inserted into the insertion portion 62 as the container 30 is inserted into the actuator support 34. The locking portion 66 may extend at an angle relative to the insertion portion 62. When the locating flange 58 is in the insertion portion 62, the container 30 may then be rotated by the user, such that the locating flange 58 moves along the locking portion 66 of the slot 54. Accordingly, the container 30 may be supported by the actuator support 34. A user may then release the container 30 and the locking portion 66 of the slot 54 may retain the container 30 in an attached position. To detach the container 30, the user may rotate the container 30 in an opposite direction and remove the container 30 via the insertion portion 62 of the slot 54.

The load cell 38 may be disposed adjacent to the actuator support 34, such that movement of the actuator support 34 may, in turn, activate the load cell 38. The load cell 38 may be, for example, a compression load cell or a tension load cell depending at least on the design of the shelf 18 and the actuator support 34. It is contemplated that the load cell 38 may be another type of load cell 38 without departing from the teachings herein.

Referring to FIGS. 1-19, the refrigerator 10 and/or the water dispensing system 14 may include the controller 42. The controller 42 may be a primary central processing unit for the refrigerator 10 or, alternatively, may be a separate controller 42 operably coupled with the water dispensing system 14. The controller 42 may be operably coupled to the load cell 38 and may be configured to receive a signal from the load cell 38. In response to the signal from the load cell 38, the controller 42 may activate the water dispensing sequence to insert water into the container 30 associated with and/or proximate to the water dispensing system 14. The controller 42 may include a processor 70, other control circuitry, and a memory 74. Stored in the memory 74 and executable by the processor 70 are instructions 78. The memory 74 may store various instructions 78 relating to various functions. The instructions 78 may include at least one instruction 78 for activating the water dispensing sequence. The instructions 78 may also include at least one instruction 78 for stopping the water dispensing sequence to stop water from flowing from the water dispenser tube 26 into the container 30. Accordingly, the controller 42 may stop the water dispensing sequence in response to a signal from the load cell 38.

In various examples, the load cell 38 may be calibrated to detect a predefined level of water within the container 30. The level of water is typically sensed and expressed in terms of weight of the water or other material, such as ice, within the container 30. The predefined level of water may be detected by the load cell 38 by detecting the weight of the container 30. In such examples, the load cell 38 may be calibrated to detect when the container 30 is in a range of from about 0% to about 100% full of water. The load cell 38 may be calibrated to detect an initial weight of the container 30. The load cell 38 may delay when the weight of the container 30 is detected by a predefined amount of time or range of times to minimize a miscalculation from an improperly engaged container 30 and/or the user holding the container 30. Alternatively, the water dispensing system 14 may include a predefined container 30, such that the weight of the predefined container 30 when empty (e.g., includes no or minimal water or liquid) is known by the load cell 38 and/or the controller 42. Additionally or alternatively, the load cell 38 may be calibrated to detect the weight of the container 30 when the container 30 includes some amount of water, other liquid, or ice. Moreover, if the container 30 includes at least the predefined level of water when initially coupled to the actuator support 34, the load cell 38 may not send a signal to the controller 42. Alternatively, if the container 30 includes less than the predefined level of water, the load cell 38 may send a signal to the controller 42 to activate the water dispensing sequence.

According to various aspects of the device, once the water within the container 30 has reached the predefined level of water, the load cell 38 may send a second signal to the controller 42 to stop the water dispensing sequence. The load cell 38 may be calibrated to detect when the container 30 is in a range of from about 50% to about 100% full of water and then send the signal when the container 30 reaches the predefined and/or a selected level of water. The percentage the container 30 is full of water or other materials may be based upon a known fluid weight capacity of the container 30. It may be advantageous for the predefined level of water in the container 30 to be less than 100% full to account for a delay in the signal from the load cell 38 to the controller 42 and/or any water remaining in tubing of the water dispensing system 14 after the signal is sent. It is also contemplated that the predefined level of water may be adjustable. In other words, the controller 42 activates the water dispensing sequence in response to the signal from the load cell 38, and the controller 42 stops the water dispensing sequence in response to another signal from the load cell 38 that the level of water in the container 30 has reached the predefined level (weight) of water.

Additionally or alternatively, the load cell 38 may send a plurality of signals to the controller 42. The load cell 38 may measure the weight of the container 30 at intervals and send a corresponding signal to the controller 42. A first signal may be sent to the controller 42 by the load cell 38 when the container 30 engages to the dispensing system 14. The controller 42 may compare the signal received from the load cell 38 with a predefined weight of the container 30. The controller 42 may then determine, based upon these signals and weight parameters, whether water should start dispensing into the container 30. As water is dispensed, the load cell 38 may send one or more signals to the controller 42 relating to the weight of the container 30. The controller 42 may compare the measured weight from the load cell 38 to a predefined weight (e.g., level of water). The controller 42 and/or the load cell 38 may determine whether the water should continue to dispense or stop dispensing into the container 30.

Referring still to FIGS. 1-19, the load cell 38 may also operate as part of a presence detector for the water dispensing system 14. In such examples, the load cell 38 may help to detect when an object, such as the container 30, is engaged with the dispenser system 14. If the load cell 38 detects the presence of an object engaged with the dispensing system 14 (e.g., through a measured weight of the container 30), the load cell 38, in conjunction with other aspects of the presence detector, may send a signal to the controller 42. This signal is communicated to the controller 42 and the controller 42, potentially in cooperation with the load cell 38, indicates that the dispenser system 42 may activate and dispense water. Alternatively, if the load cell 38 does not detect the object, such as the container 30, the load cell 38 typically will not send a signal to the controller 42 or may send a periodic signal indicating that the dispensing system 14 remain deactivated. In this way, the load cell 38 may operate as a lock, such that the dispensing system 14 activates when the load cell 38 indicates the presence of the container 30 to the controller 42 and otherwise remains deactivated.

Referring to FIGS. 2-12, the water dispenser tube 26 may extend into, or otherwise align with, the actuator support 34. In such examples, when the container 30 is inserted into the actuator support 34, a dispensing end 82 of the water dispenser tube 26 is typically aligned with an open end 86 of the container 30. Accordingly, the water dispenser tube 26 is aligned with the container 30 to insert water therein. The water dispenser tube 26 may define a serpentine shape to couple to the shelf 18 and align with the open end 86 of the container 30. The water dispenser tube 26 may be coupled to the lower surface 22 of the shelf 18. Additionally or alternatively, the water dispenser tube 26 may extend through the shelf 18, or otherwise be integrated into the shelf 18.

Figure 2:
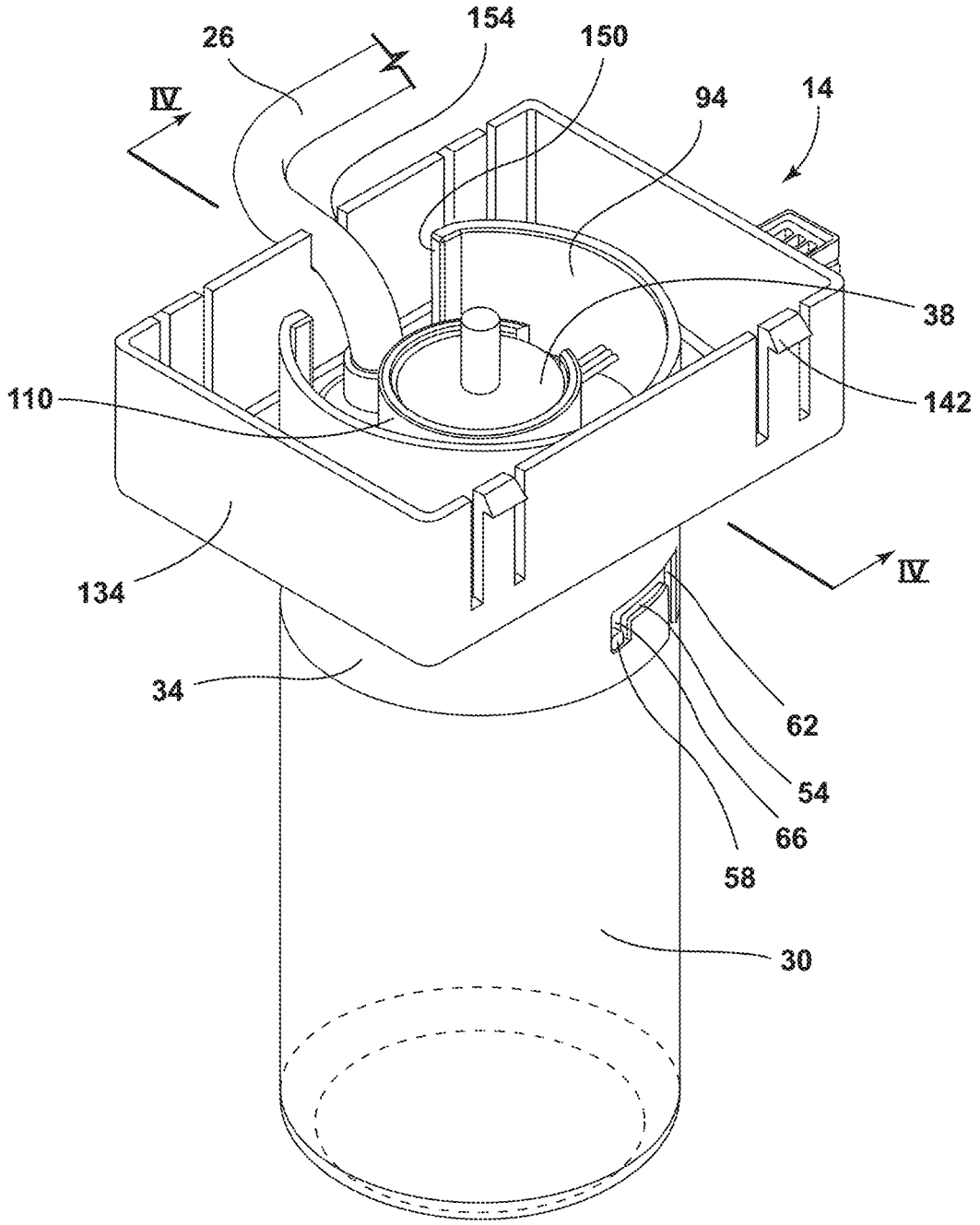
FIG. 2 is a side perspective view of the water dispensing system removed from the refrigerator, according to one example.
Figure 3:
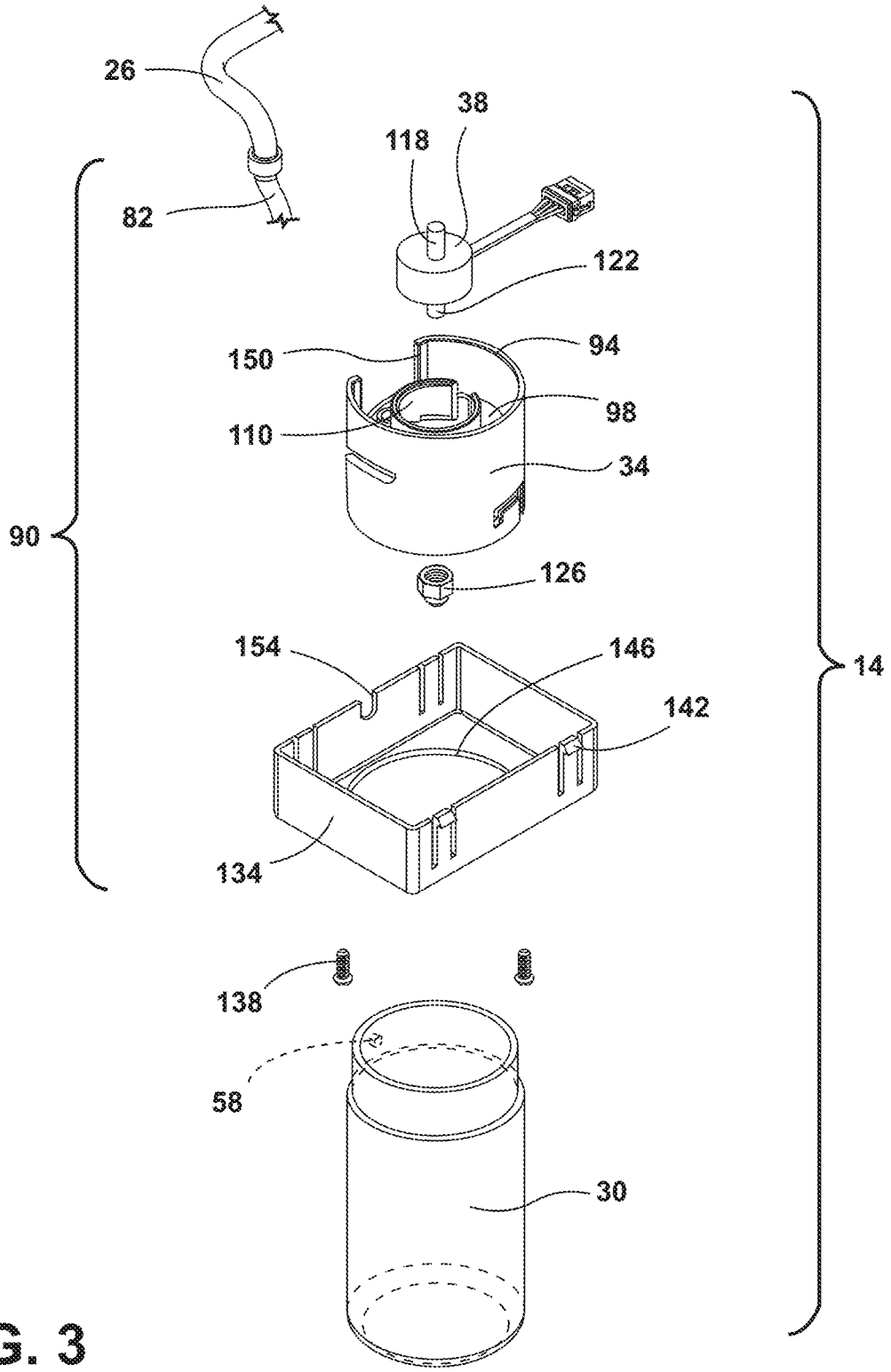
FIG. 3 is an exploded perspective view of the water dispensing system of FIG. 2, according to one example.
Figure 4:
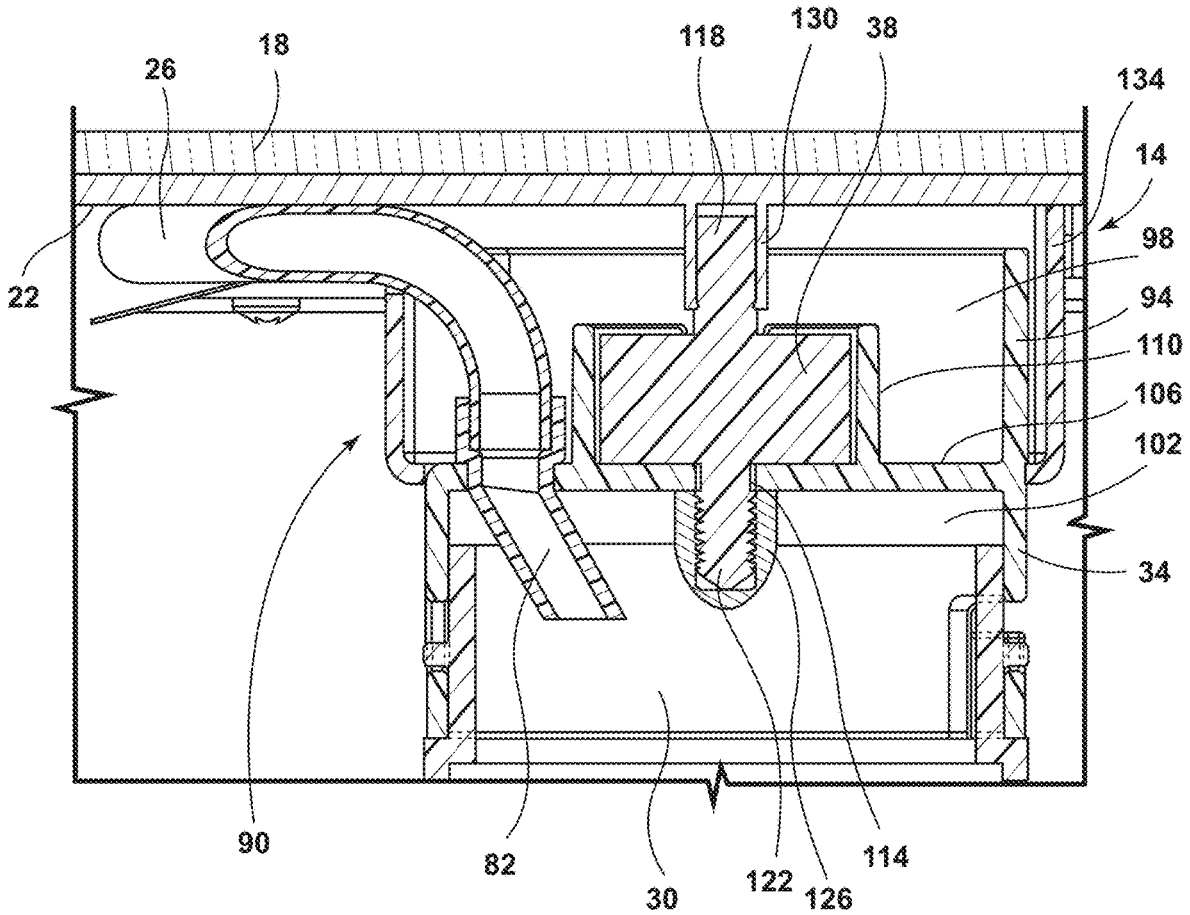
FIG. 4 is a partial cross-sectional view of the water dispensing system of FIG. 2 coupled to a shelf taken along line IV-IV, according to one example.

Referring to FIGS. 2-4, in various examples, the water dispensing system 14 may include a tension load cell assembly 90, including the load cell 38 (e.g., a tension load cell) operably coupled to the actuator support 34. In such examples, the load cell 38 extends between the shelf 18 and the actuator support 34. Additionally, the load cell 38 may be disposed on the actuator support 34, such that the actuator support 34 supports the load cell 38. The actuator support 34 may include a sidewall 94 defining an upper cavity 98 and a lower cavity 102 separated by a support wall 106. The actuator support 34 may define an enclosure 110 on the support wall 106. The load cell 38 is typically disposed within the enclosure 110 and rests upon the support wall 106. Further, the enclosure 110 is typically disposed within the upper cavity 98 of the actuator support 34. The support wall 106 may define an aperture 114, and the load cell 38 may extend at least partially through the aperture 114. Additionally or alternatively, the container 30 is typically received within the lower cavity 102 of the actuator support 34.

The load cell 38 may include an upper protrusion 118 and a lower protrusion 122. The lower protrusion 122 of the load cell 38 may extend through the aperture 114 defined by the actuator support 34. A securing cap 126 may couple to the lower protrusion 122 within the lower cavity 102. In other words, the load cell 38 may rest upon the support wall 106 within the upper cavity 98 and the lower protrusion 122 may extend through the aperture 114 into the lower cavity 102. Further, the load cell 38 may be coupled to the support wall 106 via the securing cap 126 on the lower protrusion 122. Accordingly, when the actuator support 34 moves, the actuator support 34 may pull the load cell 38. The upper protrusion 118 of the load cell 38 may be operably coupled to the shelf 18. Accordingly, the load cell 38 may detect movement of the actuator support 34 and send a signal to the controller 42 in response to detecting the movement.

In various examples, the shelf 18 may define a mounting boss 130. The mounting boss 130 may extend downward from the lower surface 22 of the shelf 18. The upper protrusion 118 may be positioned and retained within the mounting boss 130. The upper protrusion 118 may be retained via adhesive, snap-fit connection, or other coupling method. Accordingly, the load cell 38 may be coupled to the shelf 18. Additionally or alternatively, the tension load cell assembly 90 may be operably coupled to the shelf 18 and the actuator support 34. Accordingly, when the container 30 is inserted and retained on the actuator support 34, the weight of the container 30, and the contents thereof, may shift the actuator support 34 downwards. As such, the actuator support 34 may pull on the load cell 38, and as a result, the load cell 38 may send a signal to the controller 42 (FIG. 1) in response to the movement relative to the shelf 18.

Referring still to FIGS. 2-4, the water dispensing system 14 may include a housing 134 coupled to the lower surface 22 of the shelf 18. In various examples, the housing 134 may be coupled to the shelf 18 via fasteners 138, such as, for example, screws, bolts, pins, or other mechanical fasteners. It is also contemplated that the housing 134 may be adhered, welded, or otherwise coupled to the shelf 18. Further, the housing 134 may include snap members 142 for releasably engaging the shelf 18. Alternatively, the housing 134 may be integrally formed with the shelf 18. The housing 134 may have a corresponding cross-sectional shape relative to the actuator support 34, or may have a different cross-sectional shape. The actuator support 34 may be disposed on the housing 134. In various examples, the housing 134 defines a cutout 146 for accommodating the actuator support 34. The actuator support 34 may be at least partially disposed within the housing 134 and/or may extend at least partially below the housing 134 via the cutout 146. The cutout 146 may be a substantially similar cross-sectional shape and/or size as the actuator support 34. The housing 134 may at least partially conceal the tension load cell assembly 90 from the view of the user.

The sidewall 94 of the actuator support 34 may define a gap 150 adjacent to the upper cavity 98. In various examples, the water dispenser tube 26 may extend through the gap 150. Additionally or alternatively, the water dispenser tube 26 may also extend through the support wall 106 of the actuator support 34 to align with the open end 86 of the container 30 when the container 30 is inserted therein. Further, the housing 134 may define a notch 154 adjacent to the gap 150 defined by the actuator support 34. The notch 154 may be aligned with the gap 150 to accommodate the water dispenser tube 26.

Figure 5:
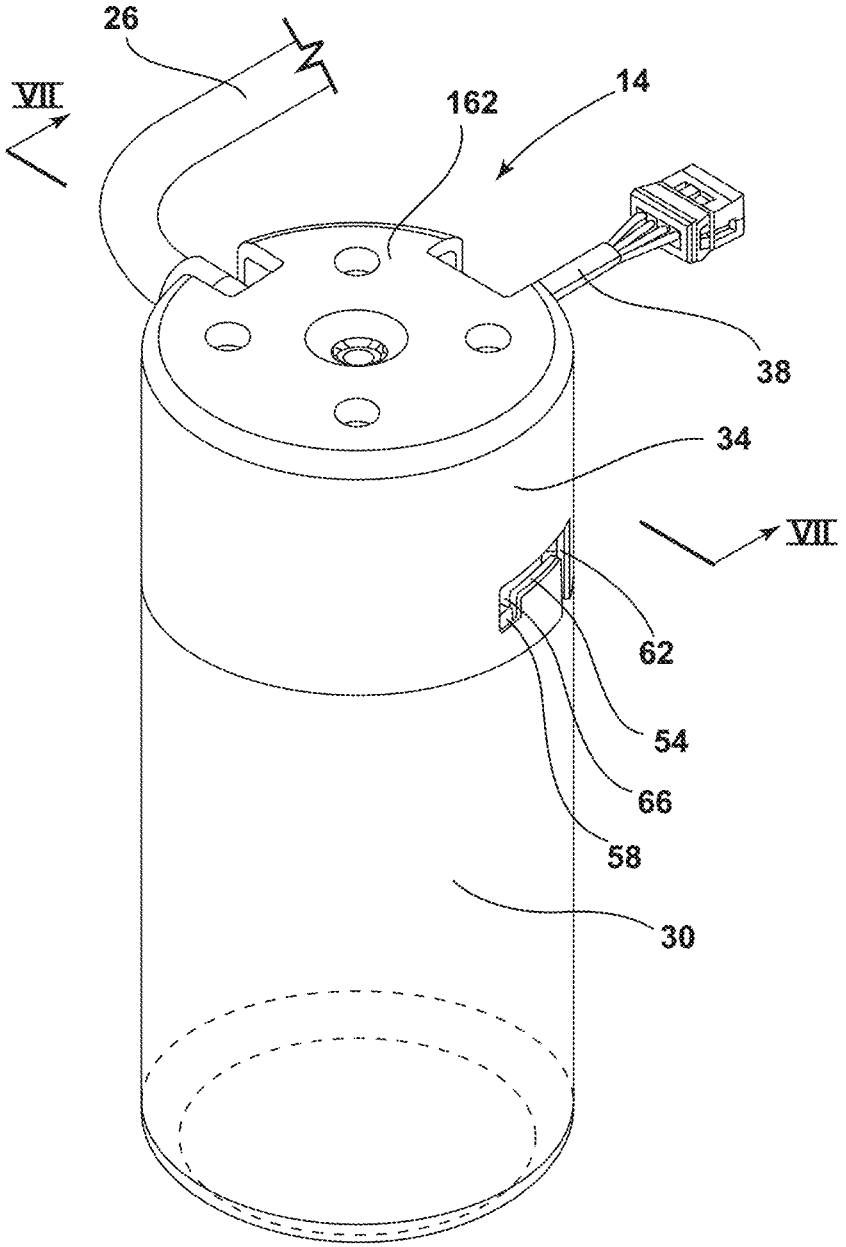
FIG. 5 is a side perspective view of the water dispensing system removed from the refrigerator, according to one example.
Figure 6:
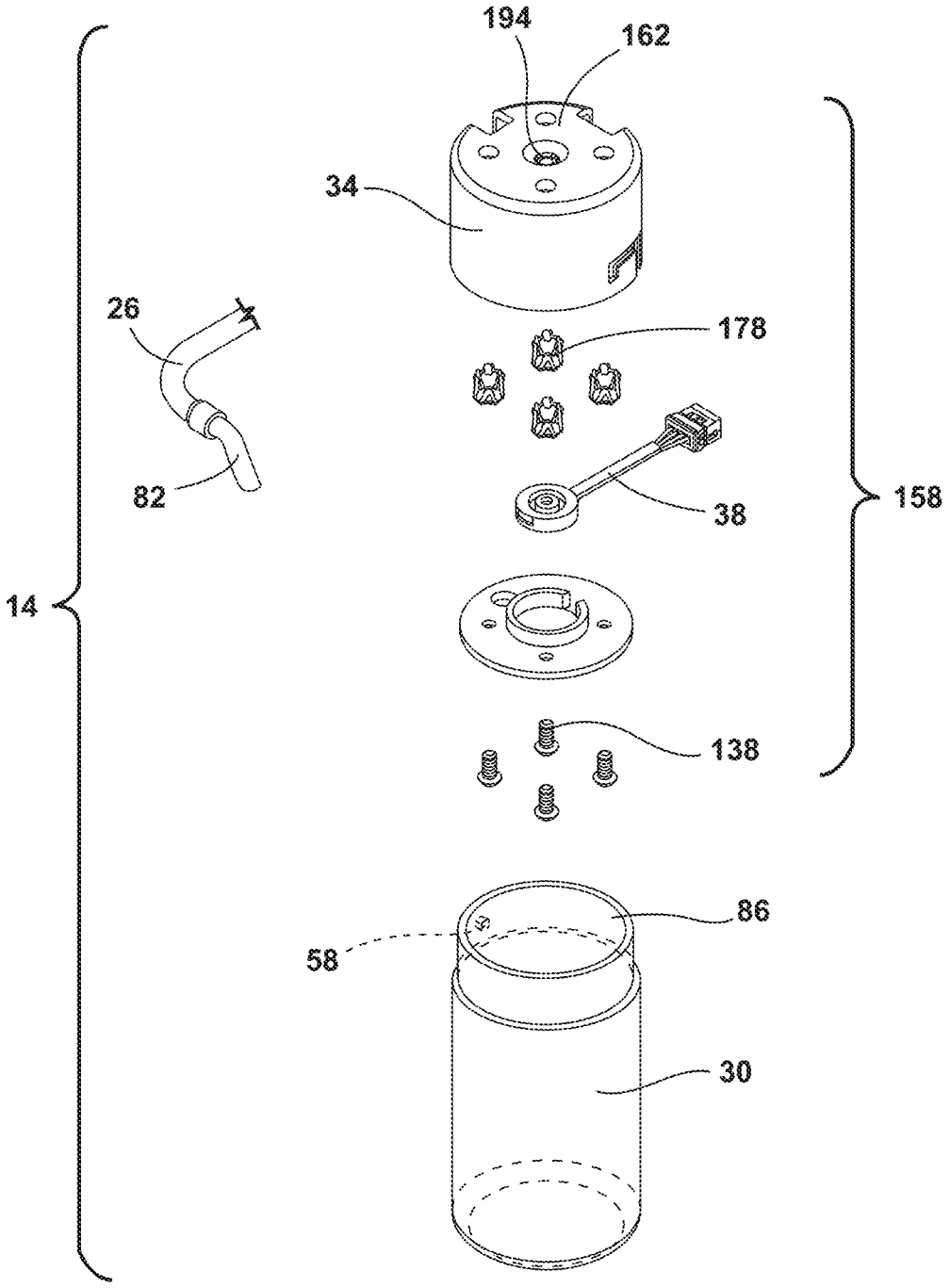
FIG. 6 is an exploded perspective view of the water dispensing system of FIG. 5, according to one example.
Figure 7:
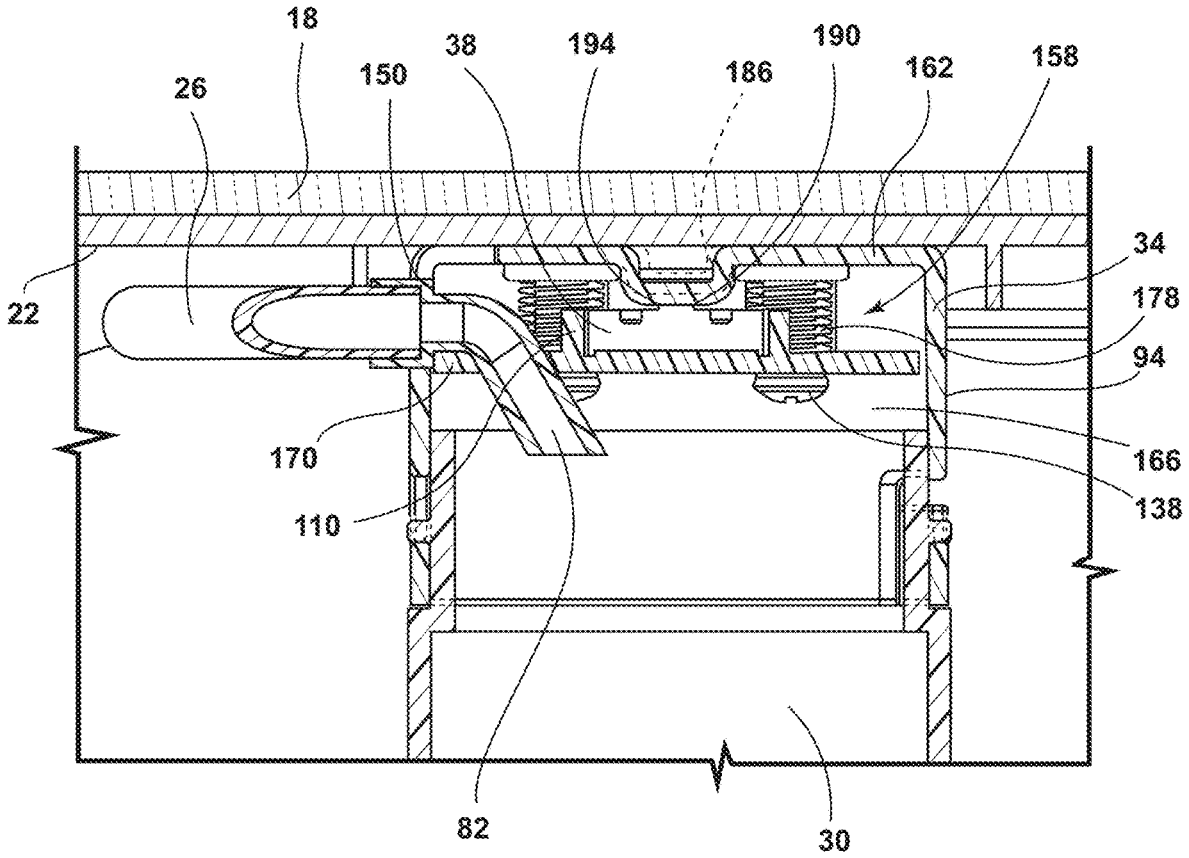
FIG. 7 is a partial cross-sectional view of the water dispensing system of FIG. 5 coupled to the shelf taken along line VII-VII, according to one example.
Figure 8:
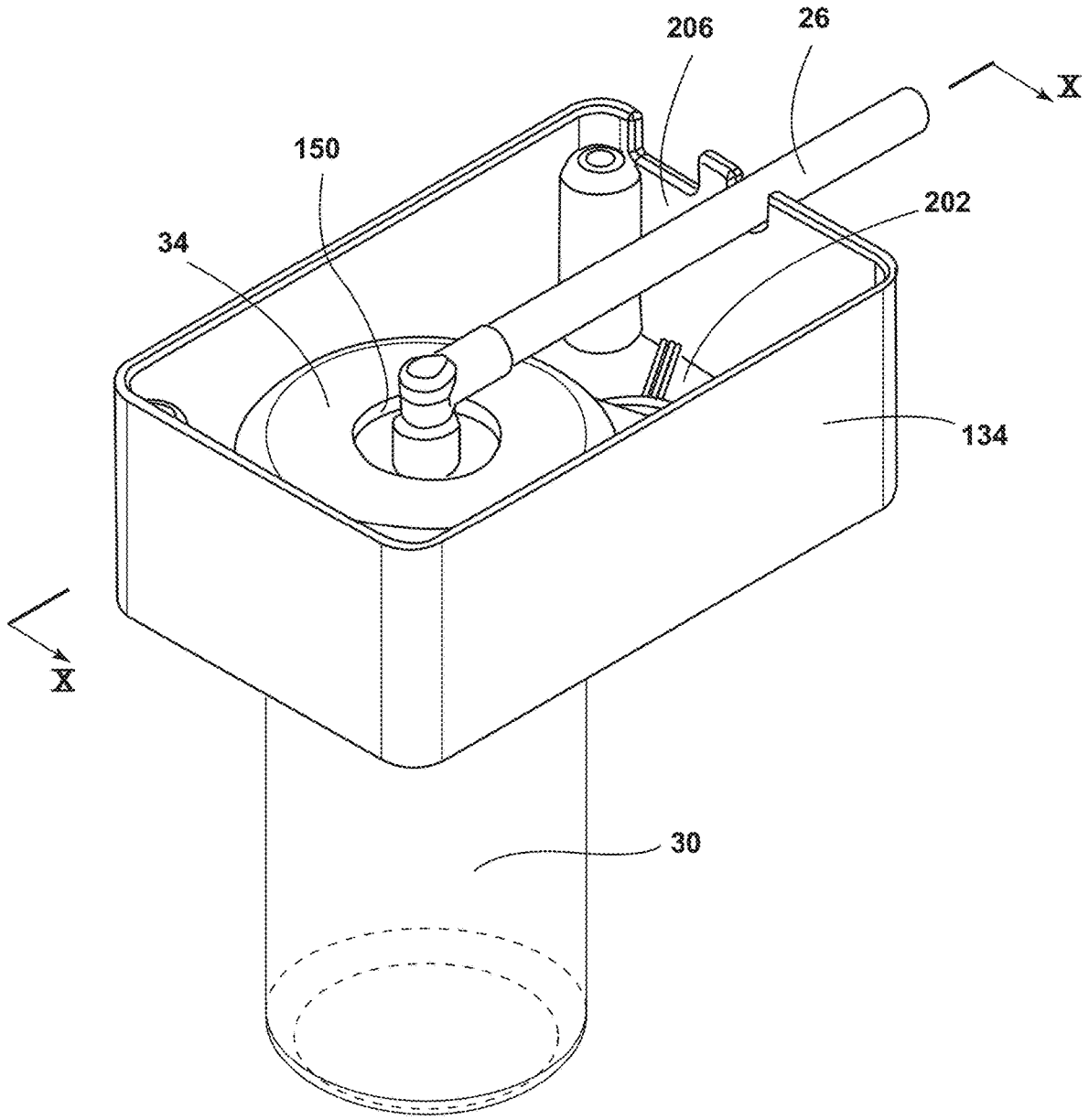
FIG. 8 is a side perspective view of the water dispensing system removed from the refrigerator, according to one example.
Figure 9:
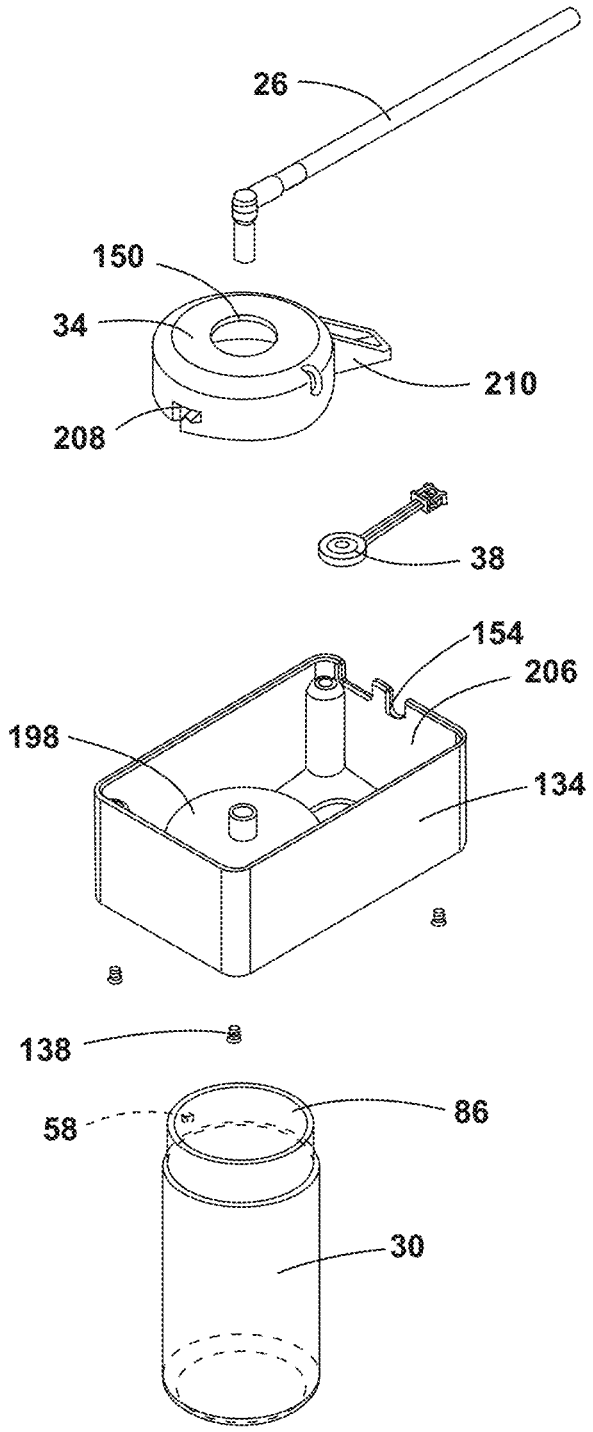
FIG. 9 is an exploded view of the water dispensing system of FIG. 8, according to one example.
Figure 10:
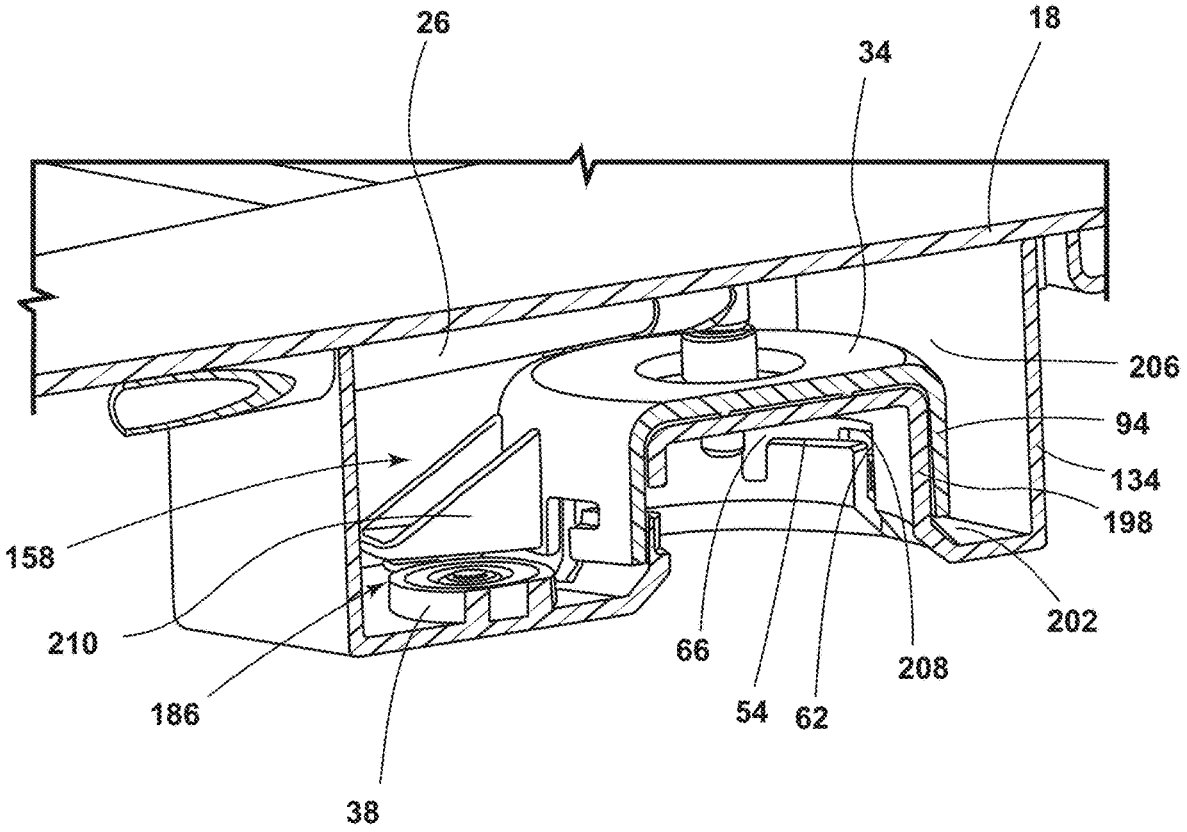
FIG. 10 is a partial cross-sectional view of the water dispensing system of FIG. 8 in a disengaged position and coupled to the shelf with a container removed taken along line X-X, according to one example.
Figure 10A:
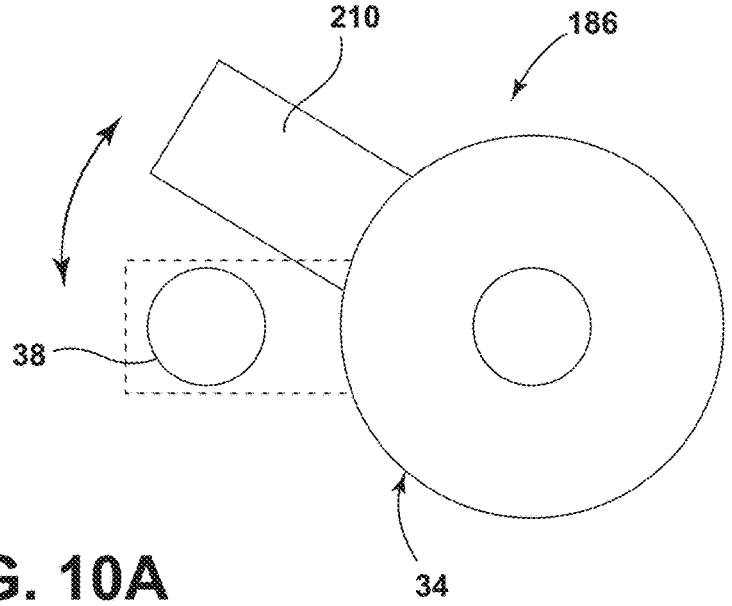
FIG. 10A is a schematic view of the water dispensing system of FIG. 8 in the disengaged position, according to one example.
Figure 11:
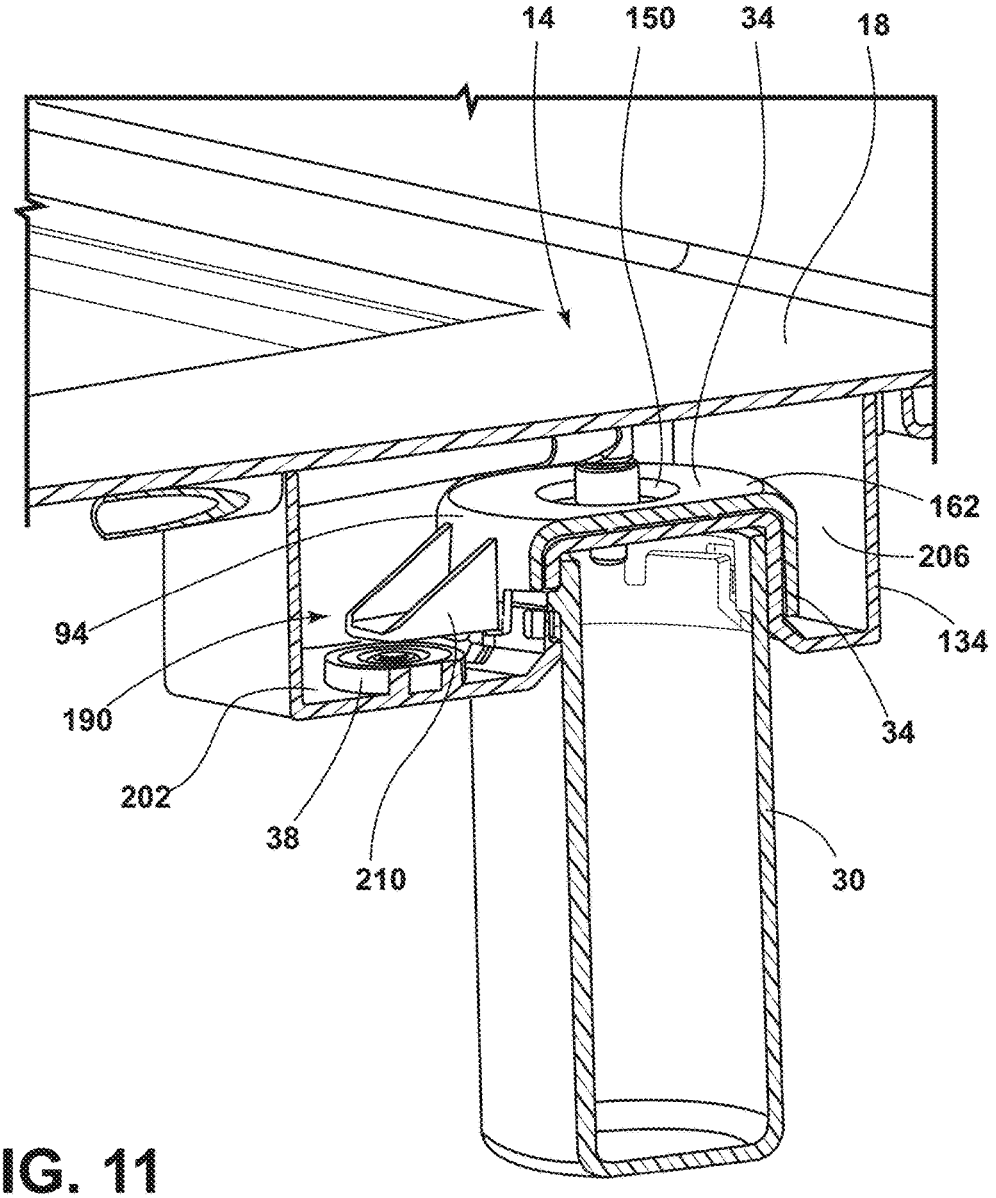
FIG. 11 is a partial cross-sectional view of the water dispensing system of FIG. 8 in an engaged position and coupled to the shelf taken along line X-X, according to one example.
Figure 11A:
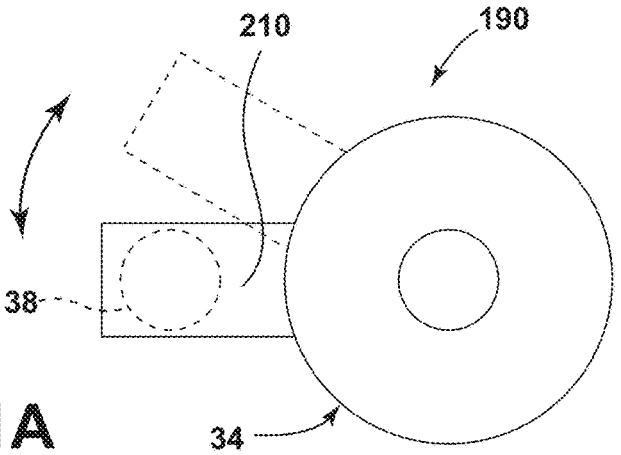
FIG. 11A is a schematic view of the water dispensing system of FIG. 8 in the engaged position, according to one example

Referring to FIGS. 5-7, in various examples, the water dispensing system 14 may include a compression load cell assembly 158. The compression load cell assembly 158 may include the actuator support 34 and the load cell 38 (e.g., the compression load cell). The actuator support 34 may be operably coupled to the shelf 18. The actuator support 34 may include the sidewall 94 and an upper wall 162 cooperating to define a cavity 166. When the actuator support 34 is operably coupled with the shelf 18, the upper wall 162 of the actuator support 34 may abut the lower surface 22 of the shelf 18. The sidewall 94 of the actuator support 34 may also define the slot 54, having the insertion portion 62 and the locking portion 66, for coupling the container 30 to the actuator support 34.

The compression load cell assembly 158 may also include a support plate 170 defining the enclosure 110 for the load cell 38. The support plate 170 may have a substantially similar cross-sectional shape as the actuator support 34, or may have a different cross-sectional shape. In various examples, the support plate 170 may be disposed within the cavity 166 defined by the actuator support 34. The load cell 38 may be disposed on the support plate 170 within the enclosure 110. The support plate 170 may define holes 174 for receiving fasteners 138. The fasteners 138 may couple the support plate 170 to the actuator support 34. Additionally or alternatively, the fasteners 138 may assist in positioning biasing members 178 on the support plate 170.

Referring still to FIGS. 5-7, the compression load cell assembly 158 may include biasing members 178 extending between the support plate 170 and the actuator support 34. As illustrated in FIG. 6, four biasing members 178 are illustrated, however it is contemplated that fewer or more biasing members 178 may be included. FIG. 6 shows elastomeric and/or resilient biasing members 178. Further, as illustrated in FIG. 7, the biasing members 178 are illustrated as springs. However, it is also contemplated that other biasing members 178 may be used without departing from the teachings herein. The biasing members 178 are disposed adjacent to the enclosure 110 and are positioned substantially equidistant from each other. The water dispensing system 14 may be biased towards a disengaged position 186 when the container 30 is not coupled to the actuator support 34. When the container 30 is coupled to the actuator support 34, the weight of the container 30 may move the actuator support 34 to an engaged position 190. The actuator support 34 may overcome an initial force of the biasing members 178 (e.g., an initial spring force) to activate the load cell 38. In various examples, the upper wall 162 of the actuator support 34 may define an engaging feature 194 configured to align with the load cell 38. When the actuator support 34 overcomes the initial force of the biasing members 178 and shifts downwards, the engaging feature 194 may engage the load cell 38, such that the load cell 38 sends a signal in response to the movement of the actuator support 34.

In various examples, the sidewall 94 of the actuator support 34 may define the gap 150 for accommodating the water dispenser tube 26. Additionally or alternatively, the support plate 170 may define an additional hole 174 for accommodating the water dispenser tube 26. In other words, the water dispenser tube 26 may extend through the actuator support 34 and the support plate 170 to align the dispensing end 82 with the open end 86 of the container 30 when the container 30 is inserted into the actuator support 34.

Referring to FIGS. 8-12, the housing 134 may define a plateau 198 extending from a bottom surface 202 of the housing 134 towards the shelf 18 and into a chamber 206 defined by the housing 134. The plateau 198 may have a cross-sectional shape that corresponds with the cross-sectional shape of the container 30 and/or the actuator support 34. In various examples, the plateau 198 may define the slot 54 including the insertion portion 62 and the locking portion 66 for retaining the container 30. The actuator support 34 may be disposed over the plateau 198. The sidewall 94 of the actuator support 34 may define an engagement notch 208 configured to align with the slot 54 defined by the housing 134. The engagement notch 208 is configured to receive the locating flange 58 of the container 30. The locating flange 58 may be configured to move along the slot 54 of the housing 134, but may not extend along the engagement notch 208. Alternatively, the locating flange 58 may engage the engagement notch 208 and rotate the actuator support 34 in conjunction with the rotation of the container 30.

In various examples, the load cell 38 may be disposed in the chamber 206 defined by the housing 134. The load cell 38 may be disposed on the bottom surface 202 of the housing 134 adjacent to the plateau 198. Additionally, the actuator support 34 may rotate between the disengaged and engaged positions 186, 190. The actuator support 34 may be biased towards the disengaged position 186. When in the disengaged position 186, the actuator support 34 may not engage and/or activate the load cell 38. In other words, the actuator support 34 may actively be rotated towards the engaged position 190. The actuator support 34 includes an engagement member 210 extending outward from the sidewall 94 of the actuator support 34 into the chamber 206 defined by the housing 134. When in the disengaged position 186, the engagement member 210 of the actuator support 34 is offset from the load cell 38. Additionally, when in the engaged position 190, the engagement member 210 may contact the load cell 38, such that the load cell 38 may send a signal to the controller 42 (FIG. 1) in response to the movement by the actuator support 34 to activate the water dispensing sequence.

Referring still to FIGS. 8-12, the upper wall 162 of the actuator support 34 may define the gap 150 for accommodating the water dispenser tube 26. Additionally, the plateau 198 of the housing 134 may define the notch 154 for accommodating the water dispenser tube 26. The gap 150 of the actuator support 34 and the notch 154 of the plateau 198 may align such that the water dispenser tube 26 extends therethrough to align with the open end 86 of the container 30 when the container 30 is coupled to the housing 134. As illustrated, the notch 154 and the gap 150 are vertically aligned, however, the notch 154 and the gap 150 may be aligned in another manner to allow the water dispenser tube 26 to extend therethrough without departing from the teachings herein.

Figure 12:
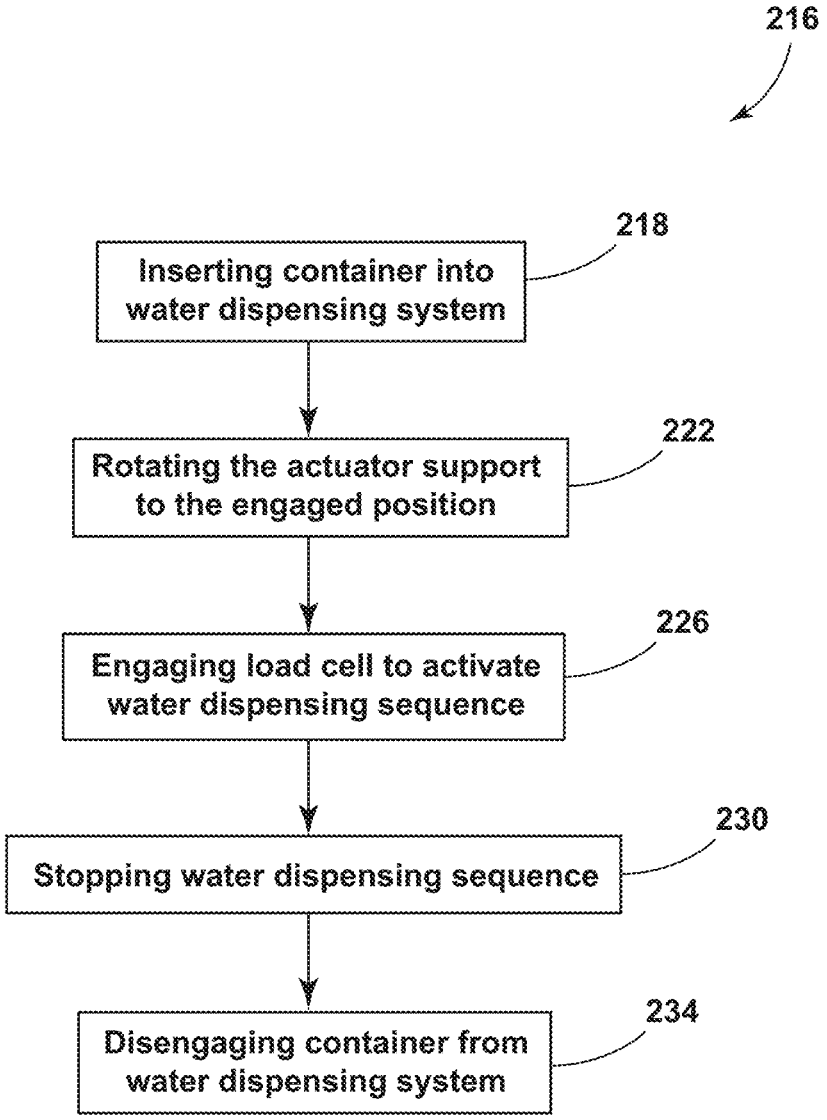
FIG. 12 is a flow diagram of a method for activating and deactivating the water dispensing system, according to one example.
Figure 13:
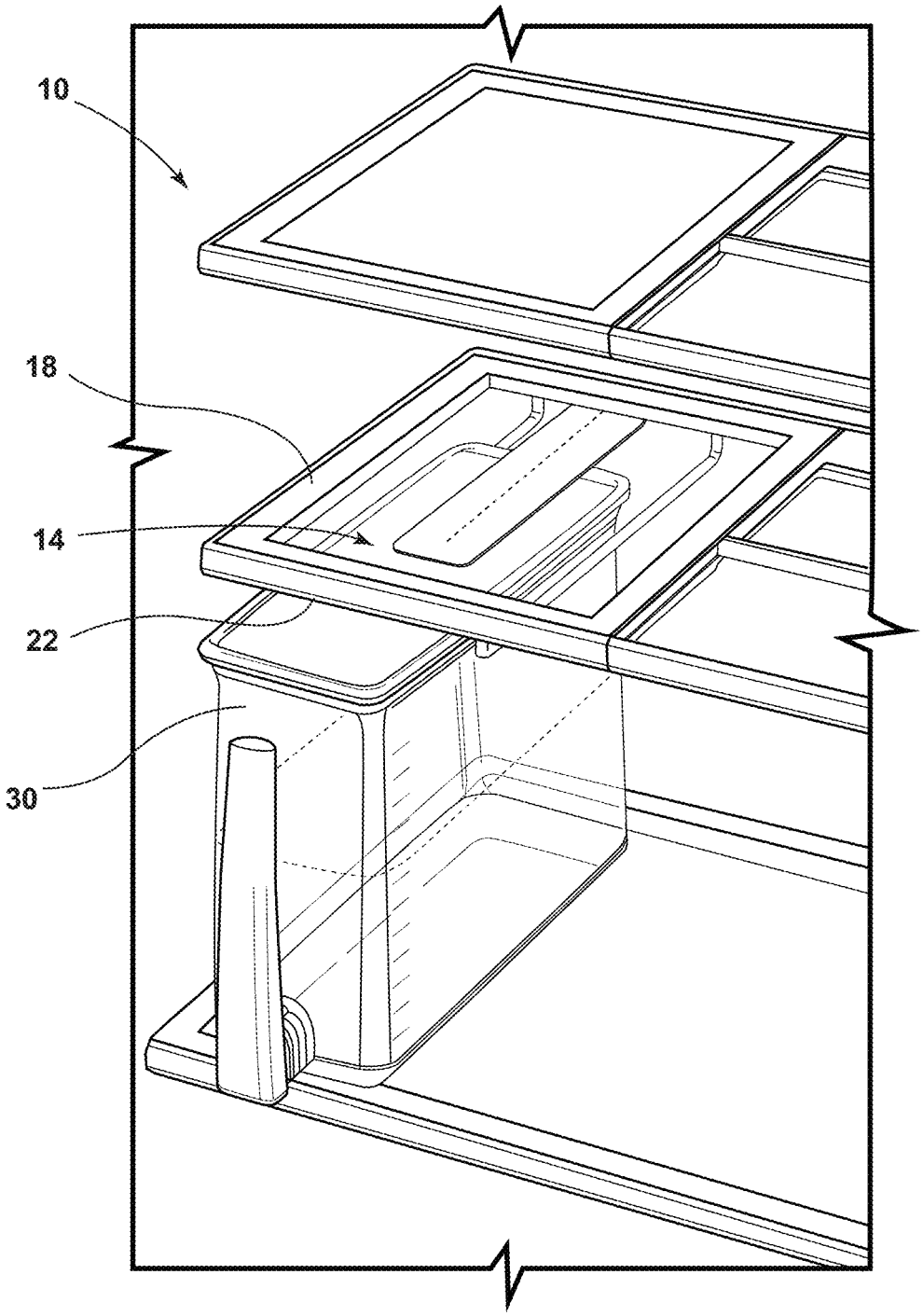
FIG. 13 is a partial front perspective view of the water dispensing system coupled to the shelf within the refrigerator, according to one example.

Referring to FIG. 12, and with further reference to FIGS. 1 and 8-11, a method 216 of activating and deactivating the water dispensing system 14 includes a step 218 of inserting the container 30 into the housing 134 of the water dispensing system 14. The locating flange 58 of the container 30 may be inserted into the insertion portion 62 of the slot 54. The step 218 additionally includes aligning and/or coupling the container 30 with the actuator support 34. In various examples, the locating flange 58 of the container 30 may engage the engagement notch 208 defined by the sidewall 94 of the actuator support 34. In the step 218, the actuator support 34 may be in the disengaged position 186 relative to the load cell 38. Next, the method 216 includes a step 222 of rotating the actuator support 34 to the engaged position 190. As the container 30 is rotated, the actuator support 34 is moved to the engaged position 190 relative to the load cell 38. In the engaged position 190, the engagement member 210 is rotated over the load cell 38. In response, in a step 226, the load cell 38 may send a signal to the controller 42 to activate the water dispensing system 14 to insert water into the container 30. In other words, the engagement member 210 engages the load cell 38, such that the load cell 38 sends the signal to the controller 42. The step 226 may include a time delay between when the engagement member 210 engages the load cell 38 and when the signal is sent to the controller 42. The delay may be advantageous to minimize inaccuracies in the detected weight of the container 30 by the load cell 38 due to misalignment of the container 30 and/or a user holding the container 30. The step 226 may further include detecting an initial weight of the container 30 and/or an initial water level within the container 30. The water dispensing sequence may continue until a step 230 where the load cell 38 sends a signal to the controller 42 to stop the water dispensing sequence. The signal from the load cell 38 may be sent when the water level in the container 30 reaches the predefined level to which the load cell 38 may be calibrated to detect. In a step 234, the user may then disengage the container 30 from the actuator support 34 of the water dispensing system 14 by rotating the container 30 such that the actuator support 34 is in the disengaged position 186.

Referring now to FIGS. 13-19, in an additional exemplary embodiment, the container 30 may be slidably received by the water dispensing system 14. In such examples, the water dispensing system 14 may be operably coupled to the shelf 18 of the refrigerator 10 or other appliance. The container 30 may be, for example, a bottle, a pitcher, or other elongated container 30. The water dispensing system 14 includes at least one actuating support member 238 operably coupled to the shelf 18. The actuating support member 238 may include a first support rod 242 and a second support rod 246. The first and second support rods 242, 246 may be spaced-apart and disposed parallel to one another or may be made of a single continuous rod. Additionally or alternatively, the first and second support rods 242, 246 may be configured to slidably receive the container 30. In other words, the first and second support rods 242, 246 may operate as rails for receiving the container 30. In such examples, the container 30 may have an upper lip 248 that engages the first and second support rods 242, 246. The actuating support member 238 may further include the actuator support 34 extending between the first and second support rods 242, 246. In various examples, the actuator support 34 may be substantially flat. The actuator support 34 may also include a tab 250 defining the gap 150 for accommodating the water dispenser tube 26. The first and second support rods 242, 246 may be coupled to the actuator support 34. Further, the first and second support rods 242, 246 may be retained to the actuator support 34 via clip members 254. Accordingly, the first and second support rods 242, 246 may be coupled to a first surface 258 (e.g., a top surface) or a second opposing surface 262 (e.g., a bottom surface) of the actuator support 34. Alternatively, the first and second support rods 242, 246 may be integrally formed with the actuator support 34.

The water dispensing system 14 may include the housing 134, which may be coupled to or integrally formed with the shelf 18. In various examples, the housing 134 may have a rectangular cross-sectional shape, which may be substantially similar to the cross-sectional shape of the container 30. However, the housing 134 may have any cross-sectional shape that supports the container 30. Additionally or alternatively, the housing 134 may be coupled to the shelf 18 proximate at least one of the tension load cell assembly 90 and the compression load cell assembly 158. The housing 134 may operate to conceal the tension load cell assembly 90 and/or the compression load cell assembly 158 from the view of the user. The bottom surface 202 of the housing 134 may define openings 266 proximate first and second sides 270, 274 of the housing 134. The first and second support rods 242, 246 may extend at least partially below the bottom surface 202 of the housing 134 for engaging the container 30. In other words, the first and second support rods 242, 246 extend through the openings 266 defined by the housing 134.

Referring still to FIGS. 13-19, the water dispensing system 14 may include at least one cover 278 that can be coupled to the housing 134. The covers 278 may each include at least one snap feature 282 for releasably coupling to the housing 134. In various examples, the water dispensing system 14 may include at least as many covers 278 as openings 266 defined by the bottom surface 202 of the housing 134. The covers 278 may substantially align with the openings 266 to form a continuous bottom surface 202 for the housing 134. The covers 278 may define indents 286 for accommodating the first and second support rods 242, 246. Accordingly, the openings 266 defined by the housing 134 may be substantially filled by the covers 278, while providing space for the first and second support rods 242, 246 to extend at least partially below the bottom surface 202 of the housing 134.

The water dispenser tube 26 may be coupled to the shelf 18 and/or integrated into the shelf 18. The water dispenser tube 26 may extend through the gap 150 defined by the actuator support 34 to align the dispensing end 82 with the open end 86 of the container 30. The water dispenser tube 26 may also extend through the notch 154 defined by the housing 134. Alternatively, the water dispenser tube 26 may extend through one of the openings 266 defined by the housing 134. In such examples, at least one of the covers 278 may define an additional indent 286 to accommodate the water dispenser tube 26.

Figure 14:
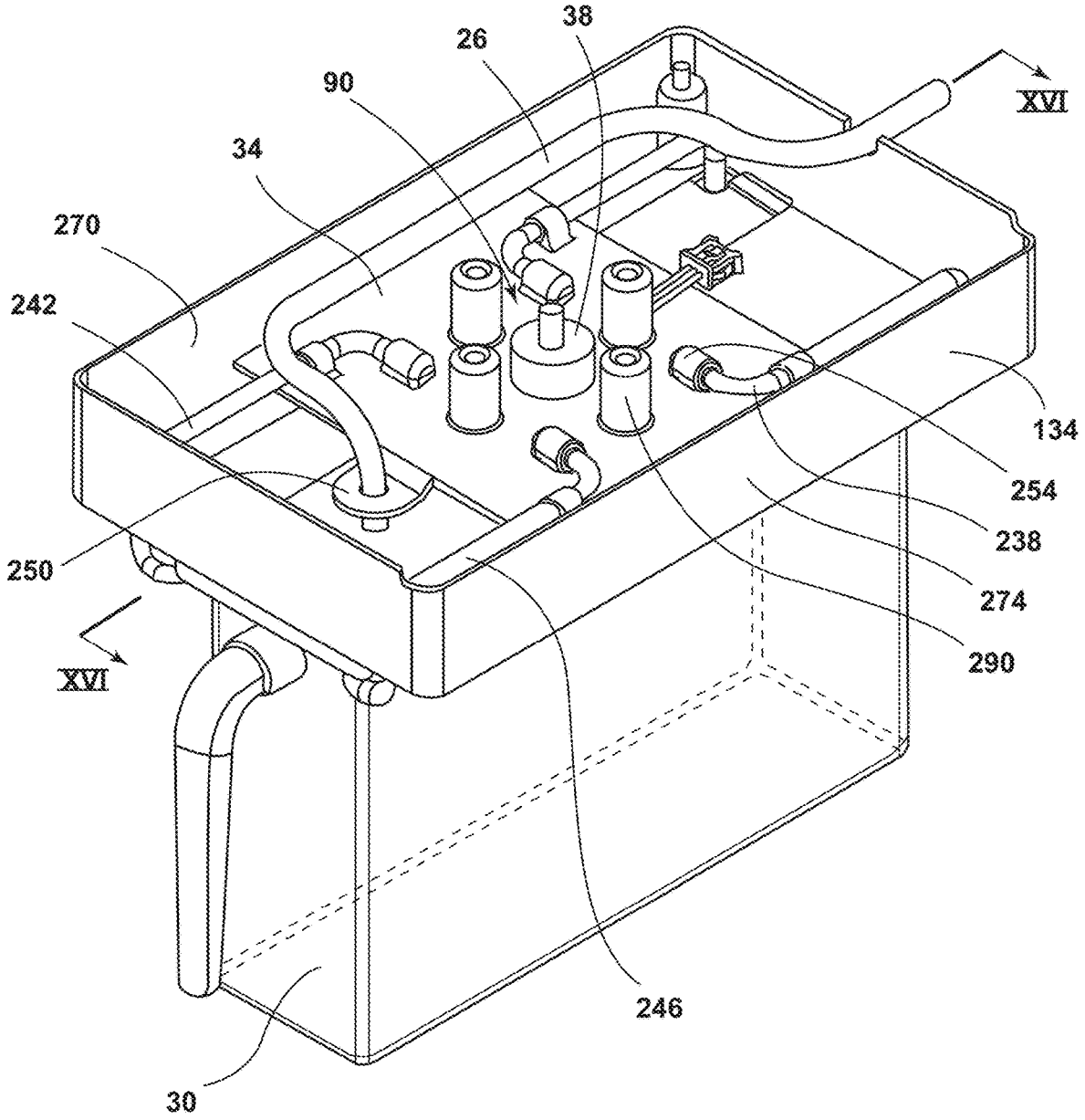
FIG. 14 is a side perspective view of the water dispensing system removed from the refrigerator, according to one example.
Figure 15:
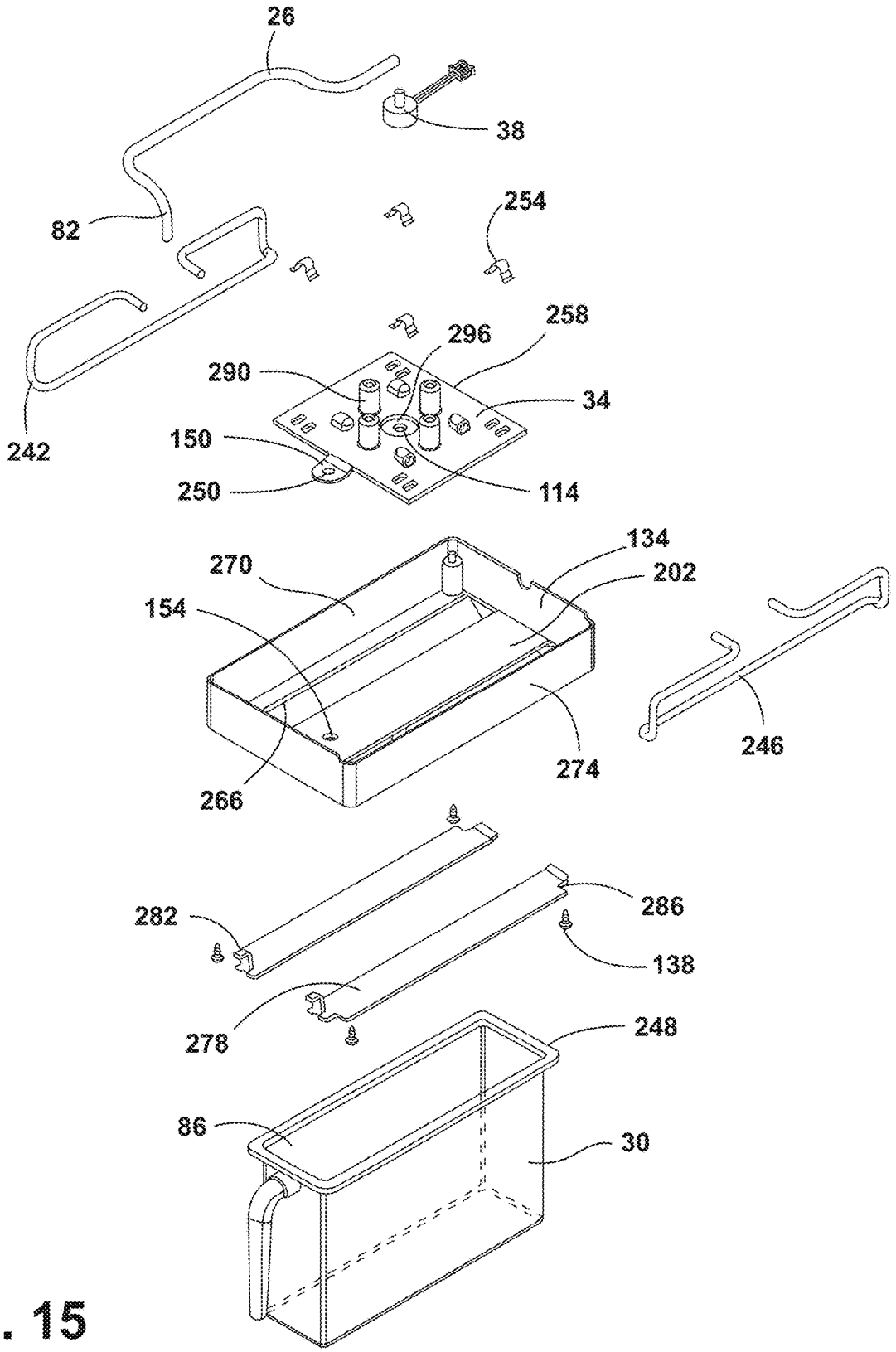
FIG. 15 is an exploded perspective view of the water dispensing system of FIG. 14, according to one example.
Figure 16:
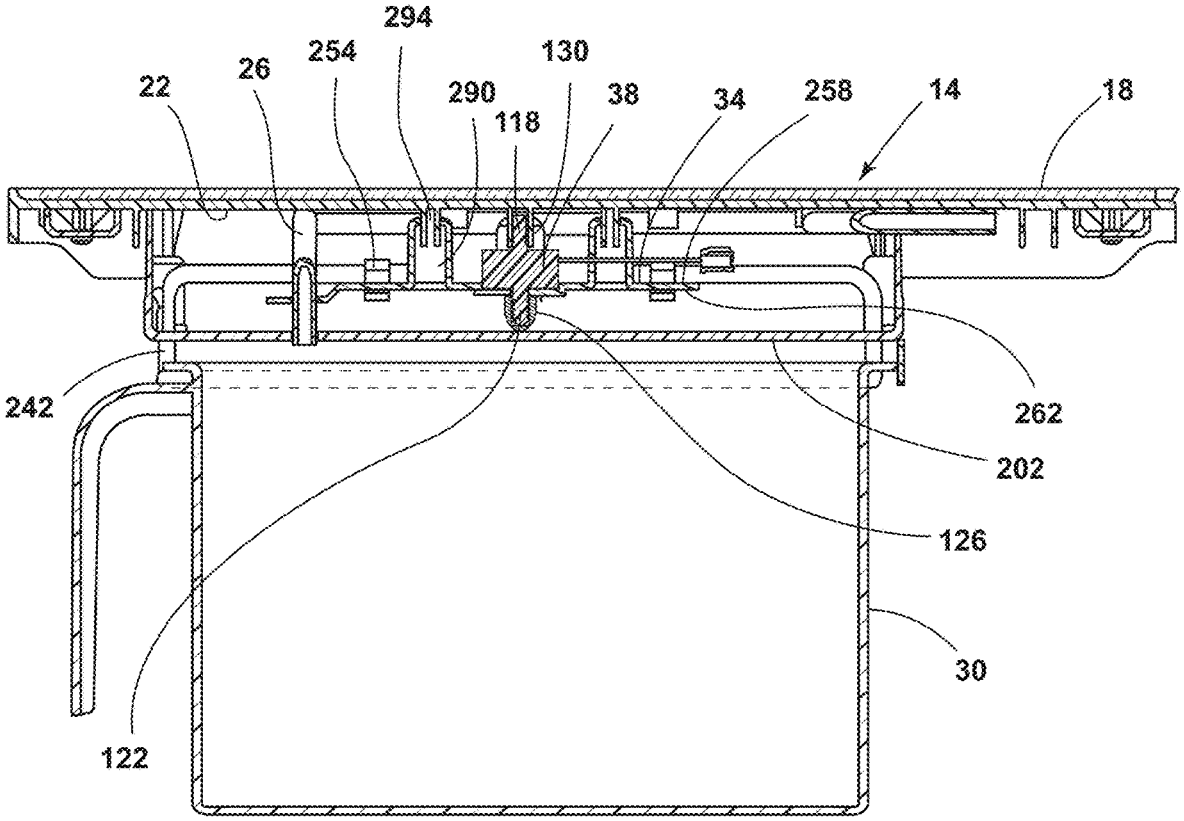
FIG. 16 is a cross-sectional view of the water dispensing system of FIG. 14 coupled to the shelf taken along line XIV-XIV, according to one example.

Referring to FIGS. 14-16, the actuator support 34 may define projections 290 extending vertically upwards towards the lower surface 22 of the shelf 18. The projections 290 may align and/or couple with protuberances 294 extending vertically downwards from the lower surface 22 of the shelf 18. The protuberances 294 may correspond and align with the projections 290 to couple the actuator support 34 to the shelf 18. Alternatively, the protuberances 294 and projections 290 may assist in properly locating and aligning the actuator support 34 relative to the shelf 18.

The water dispensing system 14 may include the tension load cell assembly 90. The tension load cell assembly 90 may include the load cell 38 (e.g., the tension load cell) and at least one actuating support member 238. Additionally, the actuating support member 238 may include the first and second support rods 242, 246 and the actuator support 34 disposed therebetween. In other words, the tension load cell assembly 90 may include the load cell 38 operably coupled to the actuator support 34. The actuator support 34 may define a recess 296 having the aperture 114 for the lower protrusion 122 of the load cell 38 to extend through. The load cell 38 may be secured to the actuator support 34 via the securing cap 126 coupled to the lower protrusion 122 on an opposing side of the actuator support 34 relative to the load cell 38. In other words, the load cell 38 may be disposed on the first surface 258 of the actuator support 34 and the securing cap 126 may abut the second opposing surface 262 of the actuator support 34.

Referring still to FIGS. 14-16, the shelf 18 may define the mounting boss 130 for the upper protrusion 118 of the load cell 38. In operation, the weight of the container 30 slidably received on the first and second support rods 242, 246 may move the actuator support 34 downwards which may then pull the load cell 38. In response, the load cell 38 may send the signal to the controller 42 in response to movement relative to the shelf 18. Additionally or alternatively, the load cell 38 may send the signal in response to movement of the actuator support 34.

Figure 17:
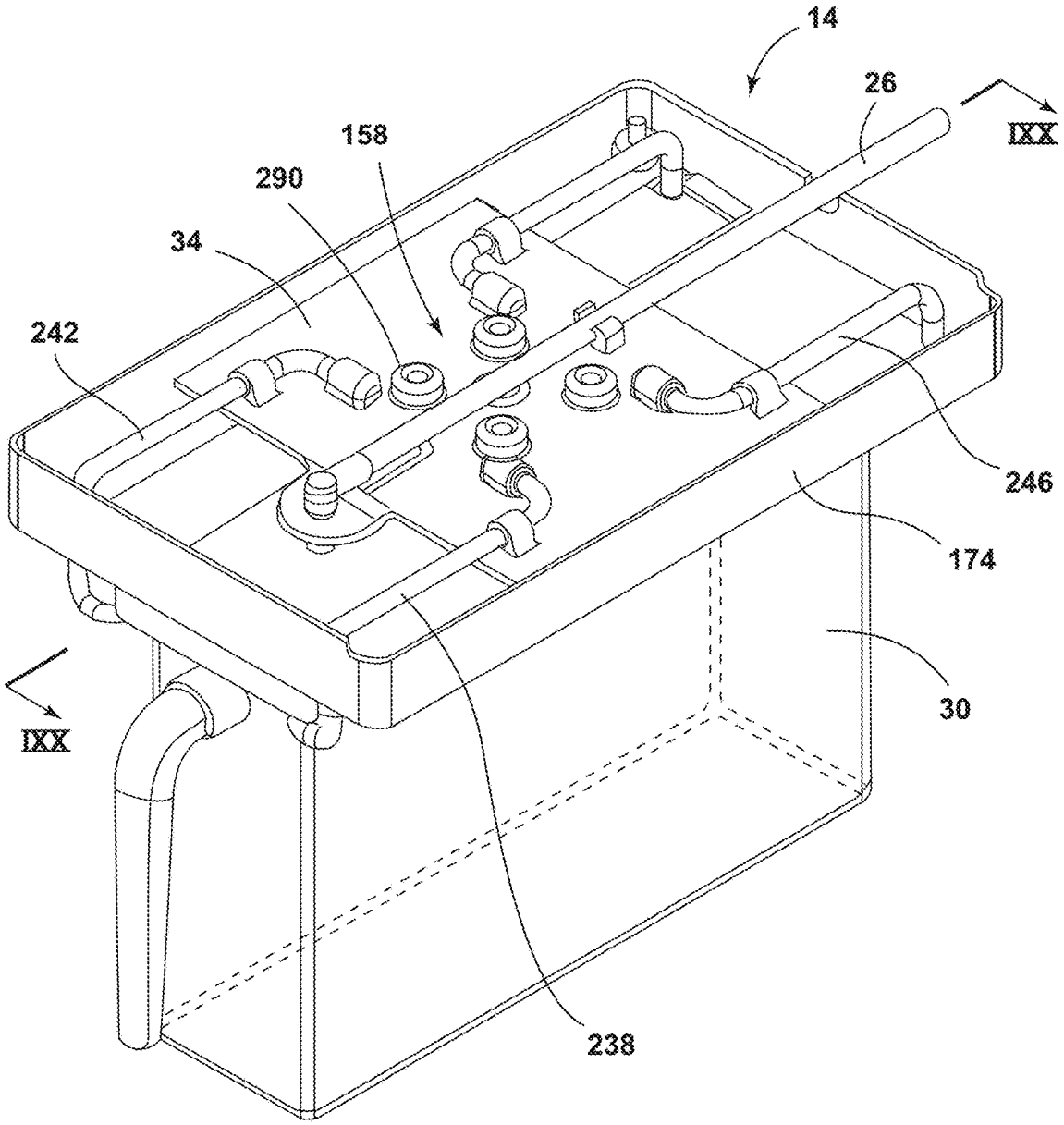
FIG. 17 is a side perspective view of the water dispensing system removed from the refrigerator, according to one example.
Figure 18:
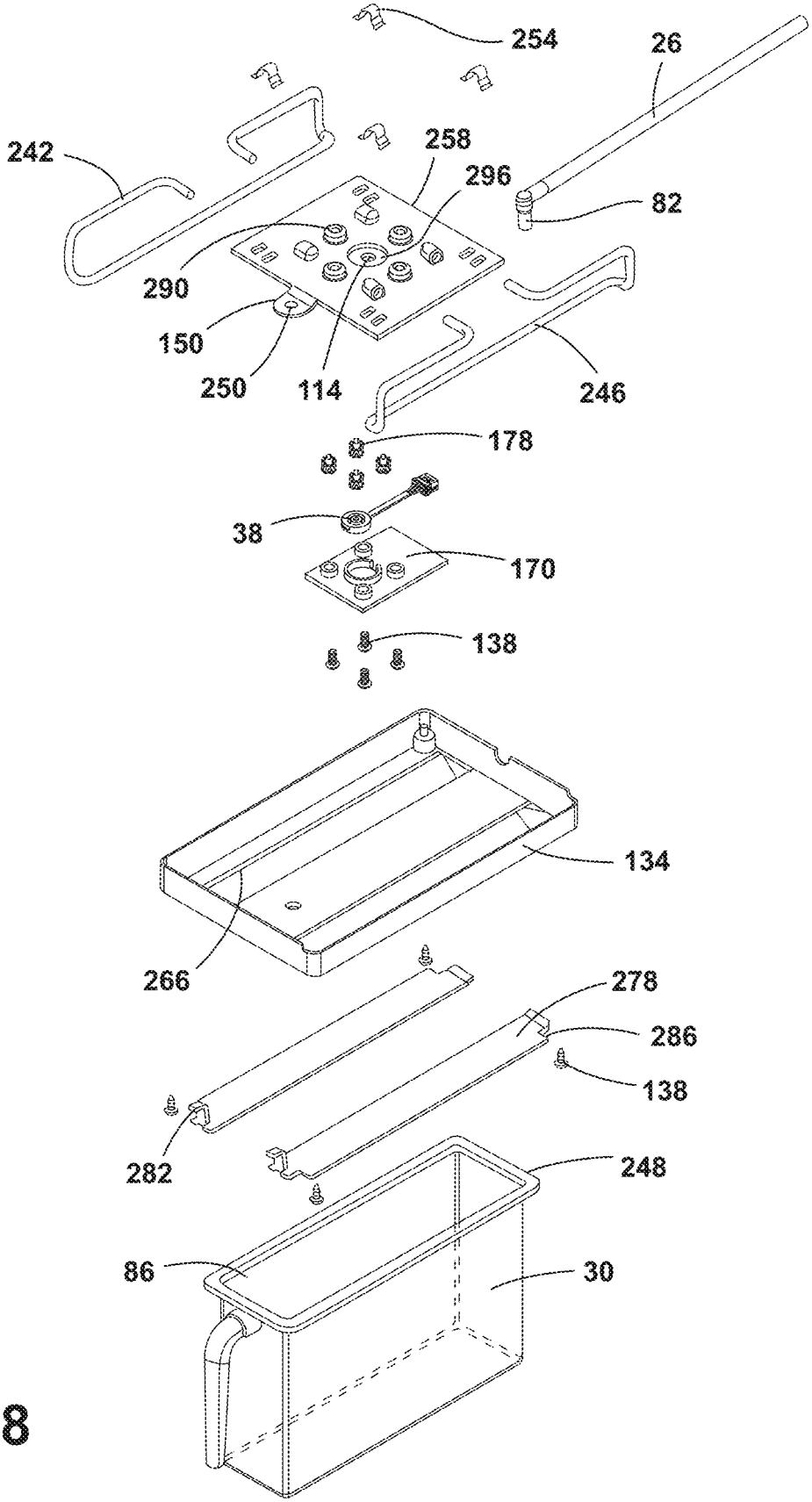
FIG. 18 is an exploded perspective view of the water dispensing system of FIG. 17, according to one example.
Figure 19:
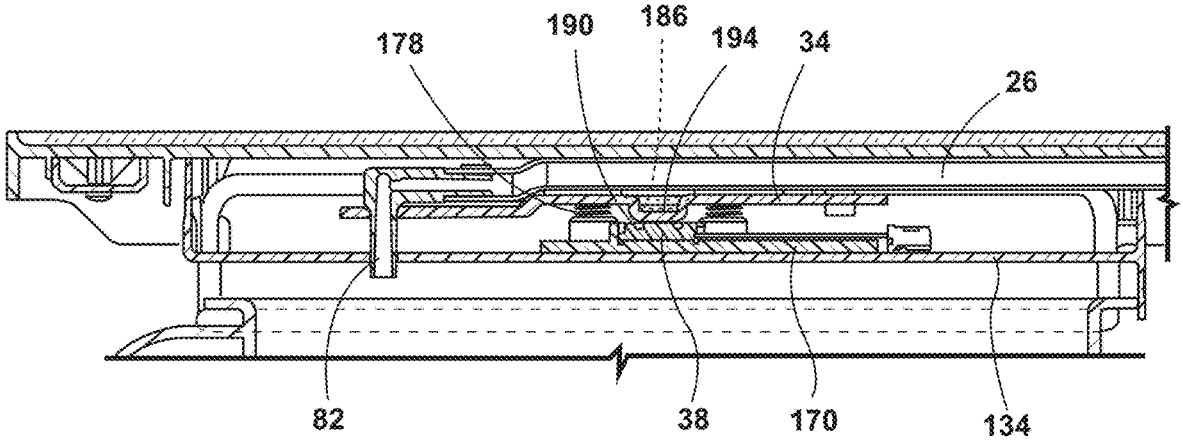
FIG. 19 is a partial cross-sectional view of the water dispensing system of FIG. 17 coupled to the shelf taken along line XIX-XIX, according to one example.

Referring to FIGS. 17-19, the water dispensing system 14 may include the compression load cell assembly 158. The compression load cell assembly 158 may include the load cell 38 (e.g., the compression load cell) and at least one actuating support member 238. The actuating support member 238 may include the first and second support rods 242, 246 and the actuator support 34. Accordingly, the compression load cell assembly 158 may be operably coupled to the actuator support 34. The compression load cell assembly 158 may further include the support plate 170 defining the enclosure 110 for receiving the load cell 38. The support plate 170 may include locating projections 290 for locating the biasing members 178. The support plate 170, as illustrated, may include four locating projections 290 that correspond with four biasing members 178, exemplified as springs. The biasing members 178 may extend between the actuator support 34 and the support plate 170.

The load cell 38 may be disposed on the support plate 170 in a center of the biasing members 178. Additionally or alternatively, the actuator support 34 may be disposed over the load cell 38 and spaced-apart from the load cell 38 by the biasing members 178. The actuator support 34 may define the engaging feature 194 configured to align with the load cell 38. In an initial position, when the container 30 is not resting on the first and second support rods 242, 246, the actuator support 34 may be in the disengaged position 186. When the container 30 rests upon the first and second support rods 242, 246, the weight of the container 30 may cause the first and second support rods 242, 246 to shift downwards. As a result, the actuator support 34 may shift downwards and overcome the initial force of the biasing members 178 to move to the engaged position 190 and engage the load cell 38. The load cell 38 may then send the signal to the controller 42 to activate the water dispensing sequence. When the container 30 is removed from the first and second support rods 242, 246, the actuator support 34 may return to the disengaged position 186. In other words, the actuator support 34 may be biased to the disengaged position 186.

Use of the present invention may provide for a variety of advantages. For example, the water dispensing system 14 may autofill the container 30 disposed proximate the water dispensing system 14 in response to the signal from the load cell 38. Further, a user may couple the container 30 to the water dispensing system 14 and not hold the container 30 in a position adjacent the water dispensing system 14. Moreover, the water dispensing system 14 may be disposed inside the cabinet 46 of the refrigerator 10 and concealed from the view of the user when the refrigerator doors 50 are in the closed position. Additionally, the water dispensing system 14 may fill the container 30 via the water dispensing system 14 and stop when the water level in the container 30 reaches a selected and/or a predefined water level, such that the water dispensing system 14 uses minimal or no user interaction. Further, the water dispensing system 14 may detect the presence of the container 30 and the water level therein. Additional benefits or advantages of using this device may also be realized and/or achieved.

According to at least one aspect, a refrigerator water dispenser includes a shelf having a lower surface. A water dispenser tube is disposed adjacent to the shelf for dispensing water into a container. An actuator support is operably coupled to the lower surface of the shelf. A load cell is disposed on the actuator support, wherein the load cell sends a signal in response to movement by the actuator support. A controller is operably coupled to the load cell, wherein the controller activates a water dispensing sequence to dispense water via the water dispenser tube in response to the signal from the load cell.

According to another aspect, the load cell is a tension load cell.

According to still another aspect, the controller stops the water dispensing sequence in response to a signal from the tension load cell that a level of water in the container reaches a predefined level of water.

According to another aspect, a support rod is coupled to the actuator support for slidably receiving the container.

According to yet another aspect, the actuator support defines a slot for receiving a locating flange of the container.

According to another aspect, the load cell is a compression load cell.

According to at least one aspect, a water dispensing system includes a shelf having a lower surface and a water dispenser tube disposed adjacent to the shelf. A tension load cell assembly is operably coupled to the shelf, wherein the tension load cell assembly sends a signal in response to movement relative to the shelf. A controller is operably coupled to the tension load cell assembly for activating a water dispensing sequence in response to the signal from the tension load cell assembly.

According to another aspect, a housing is coupled to the shelf proximate the tension load cell assembly.

According to another aspect, the tension load cell assembly extends at least partially below a bottom surface of the housing.

According to yet another aspect, the tension load cell assembly includes a tension load cell and an actuating support member, wherein the actuating support member defines a slot for receiving a locating flange of a container.

According to still another aspect, a predefined container that engages the actuating support member, wherein a weight of the predefined container moves the tension load cell assembly relative to the shelf.

According to another aspect, the controller stops the water dispensing sequence in response to a signal from the tension load cell assembly that a level of water in the predefined container reaches a predefined level of water.

According to still another aspect, the lower surface of the shelf defines a mounting boss, wherein the tension load cell assembly is coupled to the lower surface via the mounting boss.

According to at least one aspect, a water dispensing system includes a shelf and a water dispenser tube disposed adjacent to the shelf. At least one actuating support member is operably coupled to the shelf. A tension load cell extends between the shelf and the at least one actuating support member. A controller is operably coupled to the tension load cell for activating a water dispensing sequence in response to a signal from the tension load cell.

According to yet another aspect, a housing is coupled to a lower surface of the shelf.

According to another aspect, a cover includes snap features, wherein the housing defines an opening to accommodate the at least one actuating support member, and wherein the cover aligns with the opening and couples to the housing via the snap features.

According to another aspect, the at least one actuating support member includes a first support rod and a second support rod for slidably receiving a container.

According to another aspect, a housing is coupled to the shelf, wherein the first and second support rods extend at least partially below a bottom surface of the housing for engaging a container.

According to still another aspect, the at least one actuating support member includes an actuator support extending between the first and second support rods, and wherein the tension load cell is operably coupled to the actuator support.

According to another aspect, the tension load cell is coupled to the shelf and sends a signal in response to movement relative to the shelf.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance water dispenser, comprising:

a shelf having an upper surface for providing storage space and a lower surface, wherein the upper surface and the lower surface are within a single compartment; and a compression load cell assembly operably coupled to the shelf, wherein the compression load cell assembly includes:

an actuator support disposed proximate to the lower surface of the shelf, wherein a sidewall of the actuator support defines a slot;

a support plate disposed within a cavity defined at least partially by the actuator support; and a compression load cell disposed on the support plate, wherein a dispensing sequence is activated in response to a signal from the compression load cell.

2. The appliance water dispenser of claim 1, further comprising:

a biasing member disposed between the support plate and the actuator support, wherein the biasing member is configured to bias the compression load cell assembly toward a disengaged position.

3. The appliance water dispenser of claim 1, wherein the slot is configured to receive a locating flange on a container to retain the container to the compression load cell assembly, and wherein a weight of the container is configured to move the actuator support to an engaged position.

4. The appliance water dispenser of claim 3, further comprising:

a controller in communication with the compression load cell assembly, wherein the controller is configured to activate the dispensing sequence when the actuator support is in the engaged position.

5. The appliance water dispenser of claim 4, wherein the controller is configured to deactivate the dispensing sequence when a predefined level of water has been dispensed into the container.

6. The appliance water dispenser of claim 1, wherein the slot includes an insertion portion extending in a first direction along the sidewall and a locking portion extending in a second direction along the sidewall, the first direction being different than the second direction.

7. The appliance water dispenser of claim 1, further comprising:

a dispenser tube configured to extend through the actuator support to dispense water into a container during the dispensing sequence.

8. A water dispenser, comprising:

a housing configured to couple to a shelf;

an actuator support disposed within the housing;

at least one actuating support member coupled to the actuator support within the housing, wherein the at least one actuating support member includes a receiving portion disposed outside of the housing to receive a container;

a support plate disposed on a bottom surface of the housing proximate to the actuator support; and a compression load cell disposed on the support plate, wherein the at least one actuating support member is configured to adjust the actuator support between an engaged position and a disengaged position relative to the compression load cell.

9. The water dispenser of claim 8, wherein the at least one actuating support member includes a first support rod spaced from and parallel to a second support rod.

10. The water dispenser of claim 9, wherein the actuator support extends between the first support rod and the second support rod.

11. The water dispenser of claim 8, wherein a weight of the container engaging the receiving portion is configured to adjust the at least one actuating support member and the actuator support to activate a dispensing sequence.

12. The water dispenser of claim 8, further comprising:

a biasing member disposed between the support plate and the actuator support to bias the actuator support toward the disengaged position.

13. The water dispenser of claim 8, further comprising:

a controller in communication with the compression load cell, wherein the controller is configured to activate a dispensing sequence when the actuator support is in the engaged position.

14. The water dispenser of claim 13, wherein the controller is configured to deactivate the dispensing sequence in response to a signal from the compression load cell.

15. A dispensing system, comprising:

a housing configured to couple to a shelf, wherein the housing defines a plateau;

a compression load cell coupled to a bottom surface of the housing adjacent to the plateau; and an actuator support disposed on the plateau and configured to rotate between a disengaged position and an engaged position, wherein the actuator support engages the compression load cell in the engaged position.

16. The dispensing system of claim 15, wherein a sidewall of the actuator support defines an engagement notch that aligns with a slot defined by the plateau.

17. The dispensing system of claim 16, further comprising:

a container having a locating flange, wherein the locating flange is configured to move along the slot to engage the engagement notch and rotate the actuator support.

18. The dispensing system of claim 15, wherein the actuator support includes an engagement member configured to contact the compression load cell in the engaged position.

19. The dispensing system of claim 15, further comprising:

a controller in communication with the compression load cell, wherein the controller is configured to activate a dispensing sequence in response to a signal from the compression load cell.

20. The dispensing system of claim 15, further comprising:

a dispenser tube extending along a lower surface of the shelf, through the housing, and through the actuator support to dispense water into a container.

* * * * *